US007380903B2

(12) United States Patent
Kachi

(10) Patent No.: US 7,380,903 B2
(45) Date of Patent: Jun. 3, 2008

(54) INKJET RECORDING APPARATUS, AND INK DISCHARGE SURFACE CLEANING METHOD AND DEVICE

(75) Inventor: Yasuhiko Kachi, Kaiseimachi (JP)

(73) Assignee: Fujifilm Corporation, Tokyo (JP)

( * ) Notice: Subject to any disclaimer, the term of this patent is extended or adjusted under 35 U.S.C. 154(b) by 280 days.

(21) Appl. No.: 10/936,502

(22) Filed: Sep. 9, 2004

(65) Prior Publication Data

US 2005/0062797 A1 Mar. 24, 2005

(30) Foreign Application Priority Data

Sep. 10, 2003 (JP) ..... 2003-318549

(51) Int. Cl.
*B41J 2/165* (2006.01)

(52) U.S. Cl. ..... 347/33; 347/29; 347/30; 347/32

(58) Field of Classification Search ..... 347/22–35
See application file for complete search history.

(56) References Cited

U.S. PATENT DOCUMENTS

| | | | | |
|---|---|---|---|---|
| 4,951,066 | A | 8/1990 | Terasawa et al. | |
| 5,557,306 | A | 9/1996 | Fukushima et al. | |
| 5,559,539 | A * | 9/1996 | Vo et al. | 347/33 |
| 6,158,839 | A | 12/2000 | Fukushima et al. | |
| 6,193,354 | B1 * | 2/2001 | Ito | 347/30 |
| 6,637,856 | B2 * | 10/2003 | Nishi et al. | 347/29 |
| 2002/0126176 | A1 | 9/2002 | Nishi et al. | |
| 2004/0125189 | A1 | 7/2004 | Kuki et al. | |

FOREIGN PATENT DOCUMENTS

| | | | |
|---|---|---|---|
| EP | 0 314 513 | A2 | 5/1989 |
| EP | 0 314 513 | A3 | 5/1989 |
| EP | 0 602 646 | A2 | 6/1994 |
| EP | 0 602 646 | A3 | 6/1994 |
| EP | 1 405 725 | A1 | 4/2004 |
| JP | 2-518 | A | 1/1990 |
| JP | 3-99857 | A | 4/1991 |
| JP | 7-96604 | A | 4/1995 |
| JP | 7-276651 | A | 10/1995 |
| JP | 11-170566 | A | 6/1999 |
| JP | 11-342621 | A | 12/1999 |
| JP | 2000-198210 | A | 7/2000 |
| JP | 2002-240309 | A | 8/2002 |
| JP | 2004-142450 | A | 5/2004 |
| JP | 2005-22200 | A | 1/2005 |

* cited by examiner

*Primary Examiner*—Shih-wen Hsieh
(74) *Attorney, Agent, or Firm*—Birch, Stewart, Kolasch & Birch, LLP

(57) ABSTRACT

The inkjet recording apparatus comprises: a printing device including a print head which discharges ink droplets onto a recording medium to perform printing, the print head having discharge ports through which the ink droplets are discharged; a liquid removal device which absorbs droplets deposited on an ink discharge surface of the print head in which the ink discharge ports are formed; and a deposit removal device which wipes away matter deposited on the ink discharge surface.

35 Claims, 14 Drawing Sheets

INKJET RECORDING APPARATUS, AND INK DISCHARGE SURFACE CLEANING METHOD AND DEVICE

This Nonprovisional application claims priority under 35 U.S.C. § 119(a) on Patent Application No(s). 2003-318549 filed in Japan on Sep. 10, 2003, the entire contents of which are hereby incorporated by reference.

BACKGROUND OF THE INVENTION

1. Field of the Invention

The present invention relates to an inkjet recording apparatus, or to technology for maintaining and cleaning discharge surface nozzles of industrial-use droplet discharge devices or the like.

2. Description of the Related Art

In recent years, inkjet recording apparatuses (inkjet printers) serving as recording apparatuses that print/record images or the like taken by digital still camera have become widely distributed. Inkjet recording apparatuses have a plurality of recording elements in the head, the recording head is moved to scan the recording medium while ink droplets are discharged from the recording elements to the recording medium, the recording medium is conveyed by a single line when one line of image has been recorded on recording paper, and an image is formed on the recording paper by repeating these steps.

There are inkjet printers that use a short serial head and record images while causing the head to scan in the width direction of the recording medium, or those that use a line head in which recording elements are arrayed across the entire range of one side of the recording medium. In printers in which a line head is used, images can be recorded on the entire surface of the recording medium by scanning the recording medium in the direction orthogonal to the array direction of the recording elements. In printers in which a line head is used, a carriage or another conveyance system for moving the short head back and forth is unnecessary, and complex scanning control for the carriage movement and recording medium is not required. Also, the recording medium alone moves, so recording speed can be increased in comparison with printers in which a serial head is used.

In inkjet printers, when ink and other dirt deposited on the nozzle surface (the surface of the print head facing the recording surface, on which nozzle openings are formed), the result is not only nozzle discharge defects (principally abnormal flight direction of the ink droplets), but also contamination of the recorded image with this dirt.

Therefore, a variety of cleaning methods have been proposed for removing ink, paper dust, and other dirt deposited on the nozzle surface.

Also, water-repelling treatment has been performed on the nozzle surface to keep surface wettability uniform, so the liquid part of the ink deposited on the nozzle surface can be relatively easily removed, but it is still difficult to completely remove solidified ink, paper dust from the recording paper, and other types of dirt. As a result, these types of dirt on the nozzle surfaces cause the quality of the recorded image to be degraded, and therefore require to be dealt with.

On the other hand, ink has a characteristic in that its viscosity increases due to moisture evaporation when the ink is in contact with the atmosphere, eventually resulting in hardening; and this higher-viscosity ink (thickened ink) is also the cause of discharge defects in the nozzles (principally abnormal discharge amounts and non-discharge), and the recorded image may be degraded.

Conventionally, known methods for cleaning a nozzle surface include a method for wiping dirt deposited on the nozzle surface using a blade or the like. Also, methods for removing higher-viscosity ink include a method in which a dummy discharge (liquid discharge) of ink is made to a cap or the like at regular intervals.

In the inkjet recording apparatus disclosed in Japanese Patent Application Publication No. 11-342621, there is proposed a wiping mechanism that performs surface wiping action by causing a roller that is shorter in length than the head array to rotate and move in the nozzle array direction, and the wiping mechanism cleans while eliminating wiping marks on the nozzle surface by imparting a uniform pressure to the nozzle surface.

The image forming method and apparatus thereof cited in Japanese Patent Application Publication No. 11-170566 has a step of performing a preliminary discharge, a step of wiping deposited liquids, and a step of wiping deposited liquids after image formation; and removal of thickened ink and adhered ink is efficiently performed using a rotating cleaning roller and an elastic blade whose external peripheral surfaces are pressed to the head as the cleaning roller and elastic blade move relatively across the head.

Nevertheless, in the above method for cleaning a nozzle surface, the entire surface of the nozzle cannot always be uniformly cleaned. A drawback is that applying a force to the deposited matter is sometimes insufficient and the deposited matter cannot be removed. If a strong force is applied to the deposited matter, the cleaning member, the nozzle surface as such, or the nozzle surface treated with a water repellent, and other such surface-treated layers, may be damaged by the friction force generated between the nozzle surface and the cleaning member.

There is a drawback in that when dummy discharge is frequency performed to remove thickened ink in the vicinity of the discharge port, more ink is consumed.

In the inkjet recording apparatus disclosed in Japanese Patent Application Publication No. 11-342621, dry wiping takes place in the initial state of the wiping step, and the durable lifespan of the layer treated with an ink repellent on the nozzle surface is reduced.

By periodically performing preliminary discharges, the image forming method and apparatus thereof cited in Japanese Patent Application Publication No. 11-170566 circumvents a known problem in conventional inkjet technology whereby non-discharge is caused by the formation of a discharge film produced by thickened ink on the meniscus surface when the head is left in a inactive state in which no ink is discharged.

SUMMARY OF THE INVENTION

The present invention has been contrived in view of such circumstances, and an object thereof is to provide an inkjet recording apparatus, an ink discharge surface cleaning method, and a cleaning apparatus that can reliably remove liquids and other types of matter deposited on the droplet discharge surface without reducing the durable lifespan of the droplet discharge surface and cleaning member.

In order to attain the above-described object, the present invention is directed to an inkjet recording apparatus, comprising: a printing device including a print head which discharges ink droplets onto a recording medium to perform printing, the print head having discharge ports through which the ink droplets are discharged; a liquid removal device which absorbs droplets deposited on an ink discharge surface of the print head in which the ink discharge ports are formed; and a deposit removal device which wipes away matter deposited on the ink discharge surface.

In accordance with the present invention, the liquid removal device for absorbing droplets, and the deposit removal device for removing deposited matter are provided, so both droplets deposited on the ink discharge surface and solid deposits can be reliably removed.

The ink discharge surface is the surface of the print head that faces the recording medium, and the term refers to the surface in which ink discharge ports are disposed. When the vicinity of the ink discharge ports is subjected to stepped machining or another type of machining, the stepped portion and other machined portions may be included in the ink discharge surface.

The term "droplet" refers to liquids that may deposit to the ink discharge surface, and ink or other treatment solutions are also included.

The term "deposit" refers to paper dust, dirt, fine particles, or the like that come from the recording paper and other recording media. It is apparent that liquids may also be included.

Urethane foam that can absorb liquids with the aid of osmotic pressure, or another absorbent material that uses osmotic pressure, for example, may be used as the liquid removal device, and the use of a low-hardness foam material is preferred.

The deposit removal device is a member whereby frictional force or another external force can be applied and a solid deposit (adhered matter) that cannot be removed by the liquid removal device can be wiped away (scraped away) from the ink discharge surface, and a preferred aspect in one in which rubber or another material with intermediate hardness is used.

The print head may be a full-line print head in which ink discharge ports (nozzle apertures) are disposed across the entire width of the printable area in a direction that is substantially orthogonal to the conveyance direction of the printing medium, or a shuttle-scan print head in which a short print head is caused to discharge ink droplets as it moves in a direction that is substantially orthogonal to the conveyance direction of the printing medium.

In the present specification, the term "printing" expresses the concept of not only the formation of characters, but also the formation of images with a broad meaning that includes characters.

The "printing medium" is a medium (image formation medium) that receives the printing of the print head, and includes continuous paper, cut paper, seal paper, OHP sheets, and other resin sheets, as well as film, cloth, and various other media without regard to materials or shapes.

In accordance with an aspect of the present invention, the liquid removal device has an absorber that is moistened when the droplets are absorbed.

In accordance with this aspect, ink droplets are removed from the liquid removal device, the liquid removal device and the ink discharge surface are both made somewhat moist, and wet wiping can be carried out. Therefore, friction between the liquid removal device and the ink discharge surface can be reduced.

In accordance with another aspect of the present invention, the inkjet recording apparatus further comprises a meniscus control device which controls a meniscus of ink inside each of nozzles having the discharge ports when cleaning the ink discharge surface with the liquid removal device and the deposit removal device.

In accordance with this aspect, the meniscus is controlled when the ink discharge surface is cleaned; and the ink on the meniscus surface can be absorbed by the liquid removal device. Therefore, there is no need to perform ink suctioning and purging to prevent discharge defects caused by thickened ink, and ink consumption can be reduced.

As regards the meniscus control aspect, the meniscus may be controlled so as to form a convex shape in the ink discharge direction, or controlled so as to form another shape. A preferable aspect is one in which a convex-shaped meniscus is controlled so as to protrude outside the nozzle.

The deposit removal device and the ink discharge surface are moistened by ink absorbed from the meniscus by the deposit removal device, and wet wiping is performed, so the dirt deposited on the ink discharge surface can be reliably removed, and degradation due to friction between the ink discharge surface and the deposit removal device can be prevented.

In accordance with another aspect of the present invention, the inkjet recording apparatus further comprises: a movement device which moves the liquid removal device and the deposit removal device in reciprocal movement relative to the print head; and an ink discharge surface cleaning control device which controls ink discharge surface cleaning operations so that one of a liquid removal operation with the liquid removal device and a deposit removal operation with the deposit removal device is performed in an outbound path of the reciprocal movement, and the other of the liquid removal operation with the liquid removal device and the deposit removal operation with the deposit removal device is performed in an inbound path of the reciprocal movement.

In accordance with this aspect, the movement device is configured to move the liquid removal device and the deposit removal device in a reciprocating fashion relative to the print head, and to control the ink discharge surface cleaning device so that in the outbound path droplets deposited on the ink discharge surface are absorbed, or the matter deposited on the ink discharge surface is removed, and removal that is not performed in the outbound path is performed in the inbound path, so the cleaning mechanism can be simplified and costs lowered.

A preferable aspect in one in which liquid removal is performed by the liquid removal device in the outbound path, and deposit removal is performed by the deposit removal device in the inbound path. However, control may be performed so that deposit removal is performed in the outbound path and droplet removal is performed in the inbound path.

The movement device may move the liquid removal device and the deposit removal device in a relative fashion with respect to the print head in the direction of the nozzle array, or may move these in relative fashion in the direction orthogonal to the direction of the nozzle array. Of course, the configuration may be one in which movement can occur in any direction. Movement may span the entire width in the movement direction, or movement may be selectively carried out in parts within the range in which movement is allowed. In the case of a line head, when the liquid removal device and the deposit removal device are moved in the line direction, the liquid removal device and the deposit removal device can be made smaller, so this option is preferred.

In accordance with yet another aspect of the present invention, the inkjet recording apparatus further comprises: a movement device which moves the liquid removal device and the deposit removal device in reciprocal movement relative to the print head; and an ink discharge surface cleaning control device which controls ink discharge surface cleaning operations so that a liquid removal operation with the liquid removal device is performed in an outbound path of the reciprocal movement, and a deposit removal operation with the deposit removal device is performed in an inbound path of the reciprocal movement.

In accordance with this aspect, droplets are removed in the outbound movement, and the deposit removal device and the ink discharge surface are both moistened by droplets removed from the ink discharge surface, so the matter deposited on the ink discharge surface can be wiped away with wet wiping by the inbound path action.

In accordance with yet another aspect of the present invention, the liquid removal device comprises a rotor member that is rotatably driven during relative movement with respect to the print head.

In accordance with this aspect, there is rolling resistance between the ink discharge surface and the liquid removal device, the friction lifespan of the ink discharge surface and the liquid removal device can be extended, damage to the ink discharge surface can be reduced, and durability can be increased.

In accordance with yet another aspect of the present invention, the inkjet recording apparatus further comprises: a switching device which switches between driven rotation and non-driven rotation of the rotor member, wherein: the deposit removal device comprises the rotor member that is shared with the liquid removal device; and the droplets deposited on the ink discharge surface are absorbed away as the rotor member is rotatably driven for a droplet removal operation by the liquid removal device, and the matter deposited on the ink discharge surface is removed as the rotor member is urged toward the ink discharge surface without being rotatably driven in a deposit removal operation with the deposit removal device.

In accordance with this aspect, removing liquids entails absorbing droplets deposited on the ink discharge surface with the rotor member that is rotatably driven, and removing the deposit entails urging the rotor member toward the ink discharge surface without the rotor member, which has been moistened by droplets drawn up from the ink discharge surface, being rotatably driven. The deposit (solidified ink, paper dust, and the like) deposited on the ink discharge surface is removed, so the contact pressure to the ink discharge surface can be made uniform, and wipe marks can be reduced.

Non-driven rotation may be achieved by stopping the rotation of the rotor member, or by causing slippage by adding a negative load. Non-driven rotation may also be achieved by causing rotation opposite to the rotational direction of driven rotation. In other words, the rotor member should be urged so that frictional force or the like is generated on the ink discharge surface.

Also, the present invention provides a method invention for achieving the above object. In other words, the present invention is also directed to an ink discharge surface cleaning method in an inkjet recording apparatus comprising a printing device including a print head which discharges ink droplets onto a recording medium to perform printing, the print head having discharge ports through which the ink droplets are discharged, the method comprising: a liquid removal step of absorbing away droplets deposited on an ink discharge surface of the print head in which the ink discharge ports are formed; and a deposit removal step of wiping away matter deposited on the ink discharge surface after the liquid removal step.

In accordance with the present invention, when cleaning the ink discharge surface contaminated by ink droplets and other deposits, first, a liquid removal step of absorbing away droplets deposited on the ink discharge surface is performed, and subsequently, a deposit removal step of wiping away the matter deposited on the ink discharge surface after the liquid removal step is performed, so both liquids and the matter deposited on the ink discharge surface can reliably be removed. Furthermore, wet wiping is performed in the deposit removal step.

The present invention is also directed to a cleaning apparatus for a droplet discharge surface in which discharge ports for discharging droplets are formed, the cleaning apparatus comprising: a liquid removal device which absorbs droplets deposited on the droplet discharge surface; and a deposit removal device which wipes away matter deposited on the droplet discharge surface.

A preferable aspect in one in which a recovery device is provided for recovering liquids absorbed by the liquid removal device and the deposit removed by the deposit removal device.

Preferably, the liquid removal device has an absorber that is moistened when the droplets are absorbed.

In accordance with an aspect of the present invention, the cleaning apparatus further comprises: a movement device which moves the liquid removal device and the deposit removal device in reciprocal movement in a width direction of the droplet discharge surface relative to the droplet discharge surface; and a droplet discharge surface cleaning control device which controls droplet discharge surface cleaning operations so that one of a liquid removal operation with the liquid removal device and a deposit removal operation with the deposit removal device is performed in an outbound path of the reciprocal movement, and the other of the liquid removal operation with the liquid removal device and the deposit removal operation with the deposit removal device is performed in an inbound path of the reciprocal movement.

In accordance with this aspect, a series of cleaning routines can be carried out with a single reciprocate movement for the droplet discharge surface, so the time for the routines can be reduced and routines can be performed more quickly.

In accordance with another aspect of the present invention, the cleaning apparatus further comprises a meniscus control device which controls a meniscus of liquid inside each of nozzles having the discharge ports when cleaning the droplet discharge surface with the liquid removal device and the deposit removal device.

In accordance with another aspect of the present invention, the cleaning apparatus further comprises: a movement device which moves the liquid removal device and the deposit removal device in reciprocal movement in a width direction of the droplet discharge surface relative to the droplet discharge surface; and a droplet discharge surface cleaning control device which controls droplet discharge surface cleaning operations so that a liquid removal operation with the liquid removal device is performed in an outbound path of the reciprocal movement, and a deposit removal operation with the deposit removal device is performed in an inbound path of the reciprocal movement.

The deposit removal device and the droplet discharge surface can both be moistened simultaneous with the removal of droplets, and when the operation is performed during the outbound movement, removal of the deposit in the inbound path can be performed in a moist condition, the deposit can be reliably removed, and damage to the droplet discharge surface can be reduced.

In accordance with another aspect of the present invention, the liquid removal device comprises a rotor member that is rotatably driven during relative movement with respect to the droplet discharge surface.

The rotor member is preferably a material in which the frictional force or the like generated against the droplet discharge surface is small.

In accordance with yet another aspect of the present invention, the inkjet recording apparatus further comprises: a switching device which switches between driven rotation and non-driven rotation of the rotor member, wherein: the deposit removal device comprises the rotor member that is shared with the liquid removal device; and the droplets deposited on the droplet discharge surface are absorbed away as the rotor member is rotatably driven for a droplet removal operation by the liquid removal device, and the matter deposited on the droplet discharge surface is removed as the rotor member is urged toward the droplet discharge surface without being rotatably driven in a deposit removal operation with the deposit removal device.

In accordance with the present invention, there is provided a liquid removal device for absorbing away droplets deposited on the ink discharge surface, and a deposit removal device for removing the deposited matter, so droplets and deposits on the ink discharge surface can reliably be removed. It is preferable that the ink discharge surface or the deposit removal device be moistened (wetted) so that removal of the deposit is performed in wet wiping conditions.

When the meniscus inside the nozzle is controlled so as to form a convex shape in the discharge direction when cleaning the ink discharge surface, the thickened ink on the meniscus surface can be removed.

There is also provided a configuration that has a movement device for moving a liquid removal device and a deposit removal device in a reciprocating fashion along an ink discharge surface, that absorbs away droplets deposited on the ink discharge surface by means of the liquid removal device with one of the movements, and that removes the matter deposited on the ink discharge surface by means of the deposit removal device with the other movement, so a greater functional simplicity can be realized, and the configuration contributes to lower costs. When droplets are absorbed away in the outbound path action, and the deposits are removed by inbound path action, the deposit removal device and the droplet discharge surface can both be moistened simultaneous with the removal of droplets in the outbound path action, so the deposit can be removed in wet wiping conditions.

When the liquid removal device is a rotor member and is rotatably driven along the ink discharge surface as the cleaning apparatus is moved along the ink discharge surface, rolling friction is generated between the ink discharge surface and the liquid removal device, so there is a beneficial effect in that the friction between the ink discharge surface and the liquid removal device is reduced. Furthermore, when the liquid removal device and the deposit removal device are composed of the same rotor member, and control is performed so that the rotor member is rotatably driven when removing liquids and is not rotatably driven during deposit removal, the rotor member rotates when removing liquids, and is not rotatably driven but is caused to slide (slip) as it moves on the ink discharge surface during deposit removal.

The present invention is applicable as a cleaning apparatus for discharge heads in which discharge ports for discharging water, chemical solutions, and treatment solutions or the like are disposed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
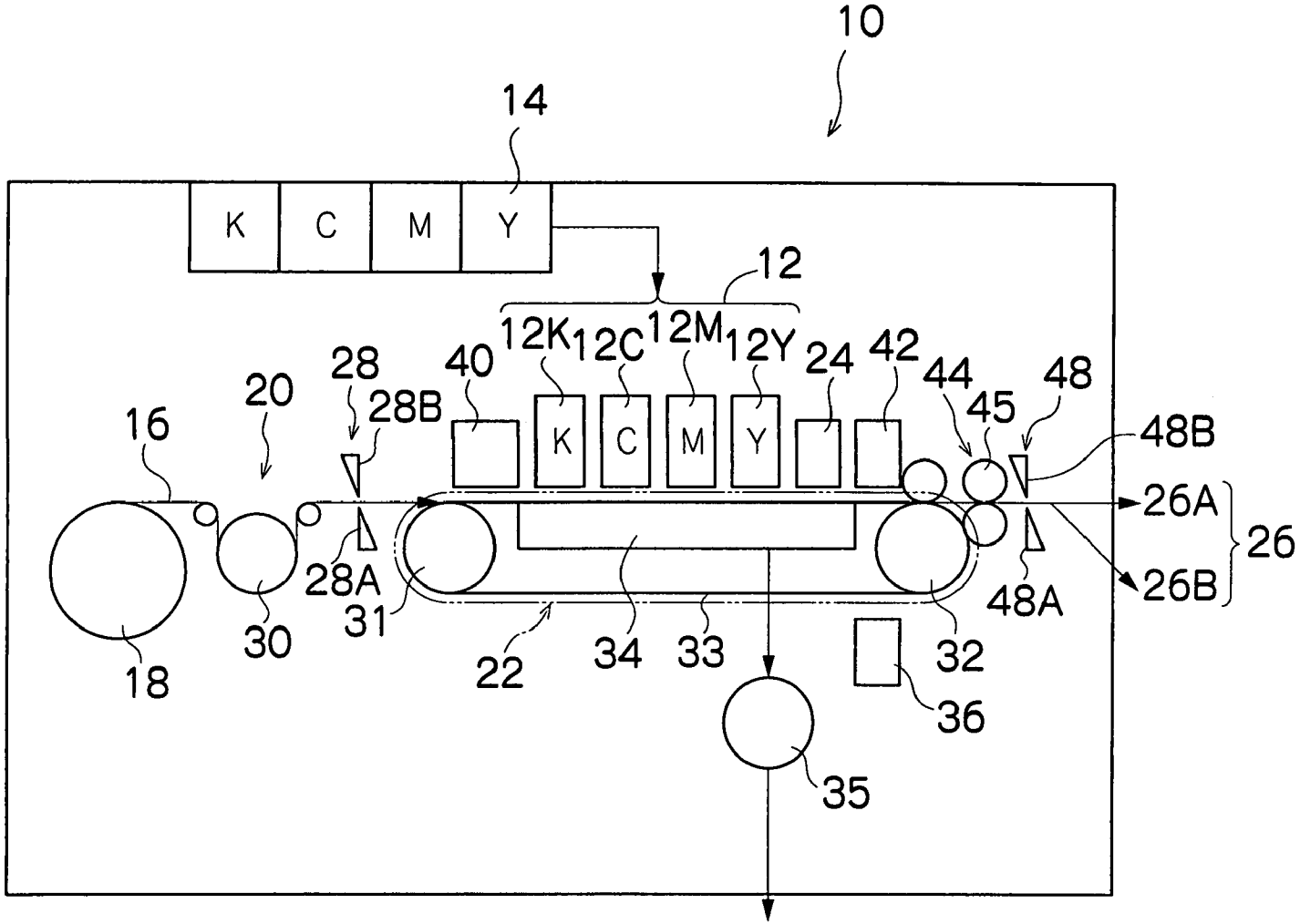
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a line CCD sensor 21 for determining the shape, orientation, and position of the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 88 in FIG. 7) being transmitted to at least one of the rollers 31 and 32, which the belt 33 is set around, and the recording paper 16 held on the belt 33 is conveyed from left to right in FIG. 1. The belt 33 is described in detail later.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
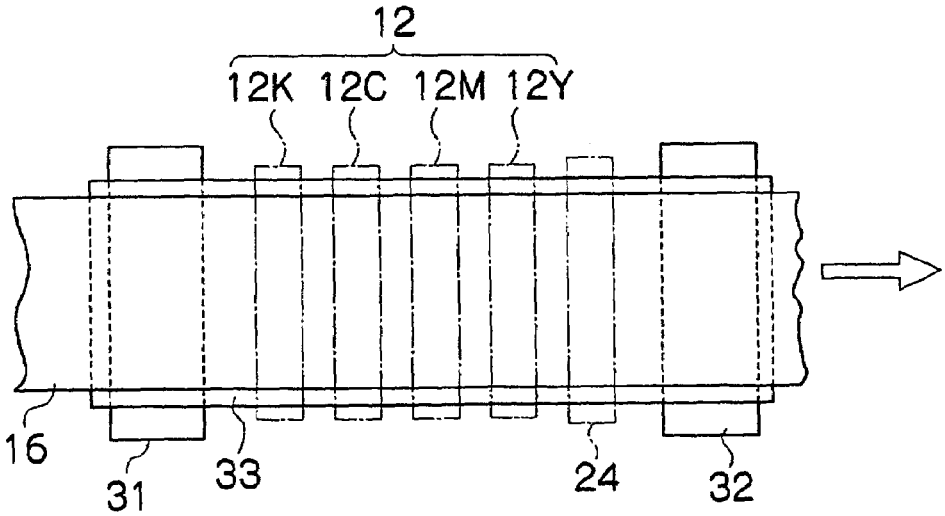
FIG. 2 is a plan view of principal components of an area around a printing unit of the inkjet recording apparatus in FIG. 1.

As shown in FIG. 2, the printing unit 12 forms a so-called full-line head in which a line head having a length that corresponds to the maximum paper width is disposed in the main scanning direction perpendicular to the delivering direction of the recording paper 16 (hereinafter referred to as the paper conveyance direction) represented by the arrow in FIG. 2, which is substantially perpendicular to a width direction of the recording paper 16. A specific structural example is described later with reference to FIGS. 3A to 5. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in this order from the upstream side along the paper conveyance direction. A color print can be formed on the recording paper 16 by ejecting the inks from the print heads 12K, 12C, 12M, and 12Y, respectively, onto the recording paper 16 while conveying the recording paper 16.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. Moreover, a configuration is possible in which a single print head adapted to record an image in the colors of CMY or KCMY is used instead of the plurality of print heads for the respective colors.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator) for warning when the remaining amount of any ink is low, and has a mechanism for preventing loading errors among the colors.

The print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position. Also, the print determination unit 24 is provided with a light source (not shown) for directing light to dots formed by deposited droplets.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints. The paper output unit 26B is for the printed matter with the test print.

Next, the structure of the print heads is described. The print heads 12K, 12C, 12M, and 12Y provided for the ink colors have the same structure, and a reference numeral 50 is hereinafter designated to any of the print heads 12K, 12C, 12M, and 12Y.

Figure 3A:
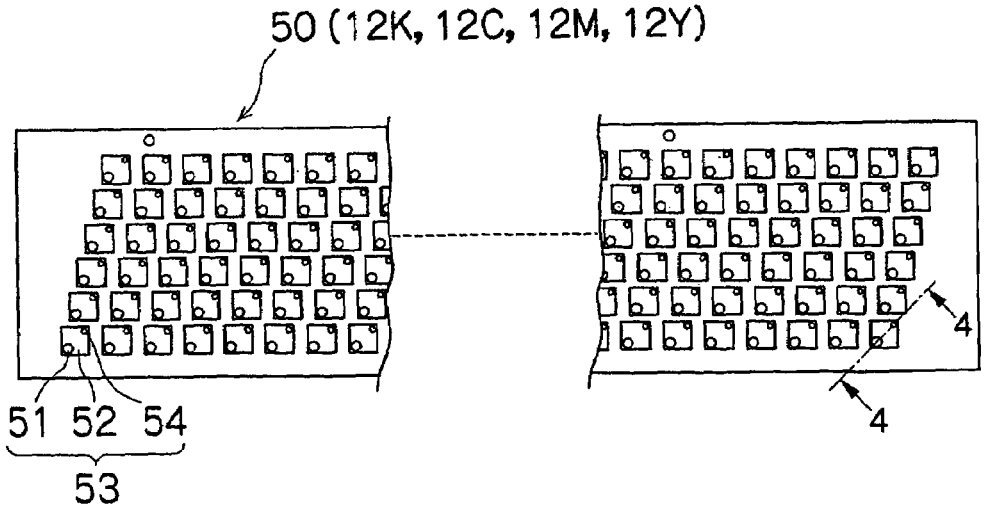
FIG. 3A is a perspective plan view showing an example of a configuration of a print head.
Figure 3B:
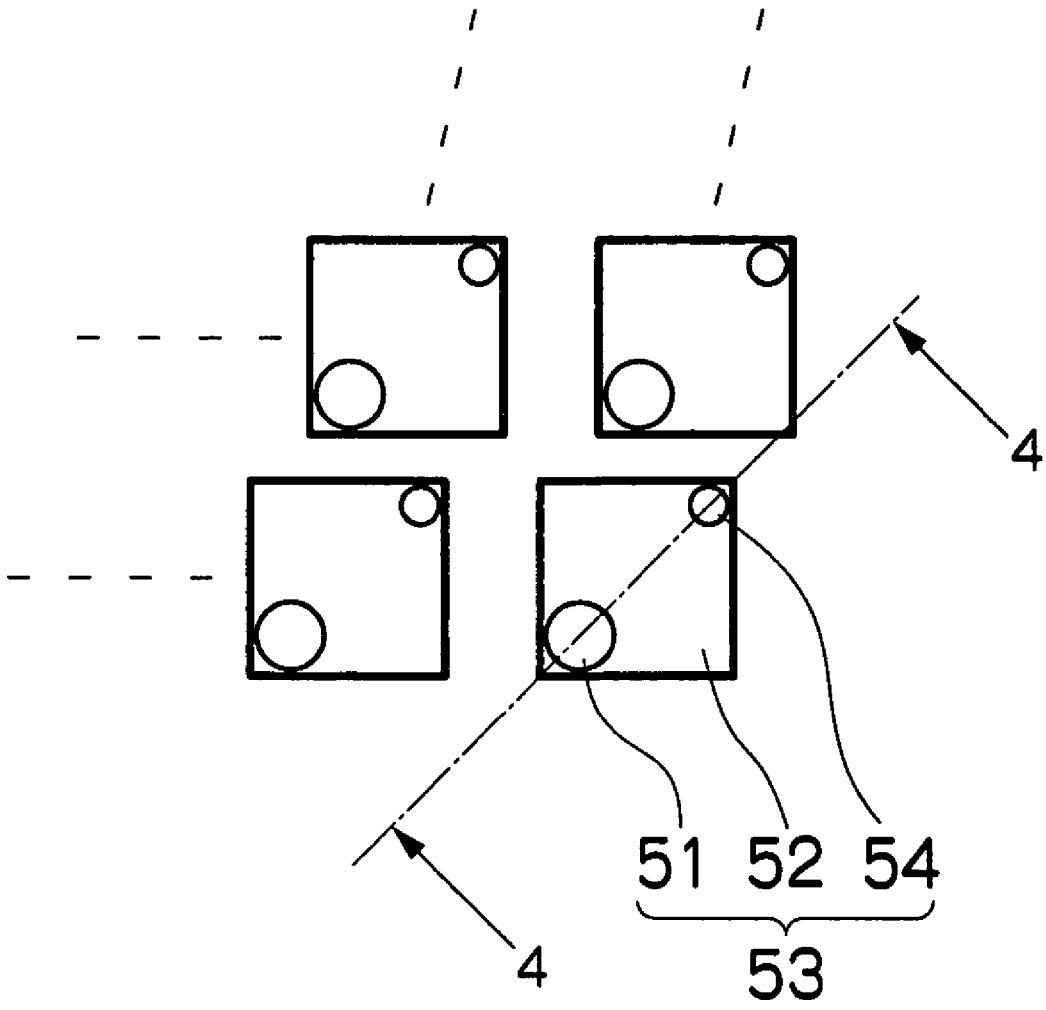
FIG. 3B is a partial enlarged view of FIG. 3A.
Figure 3C:
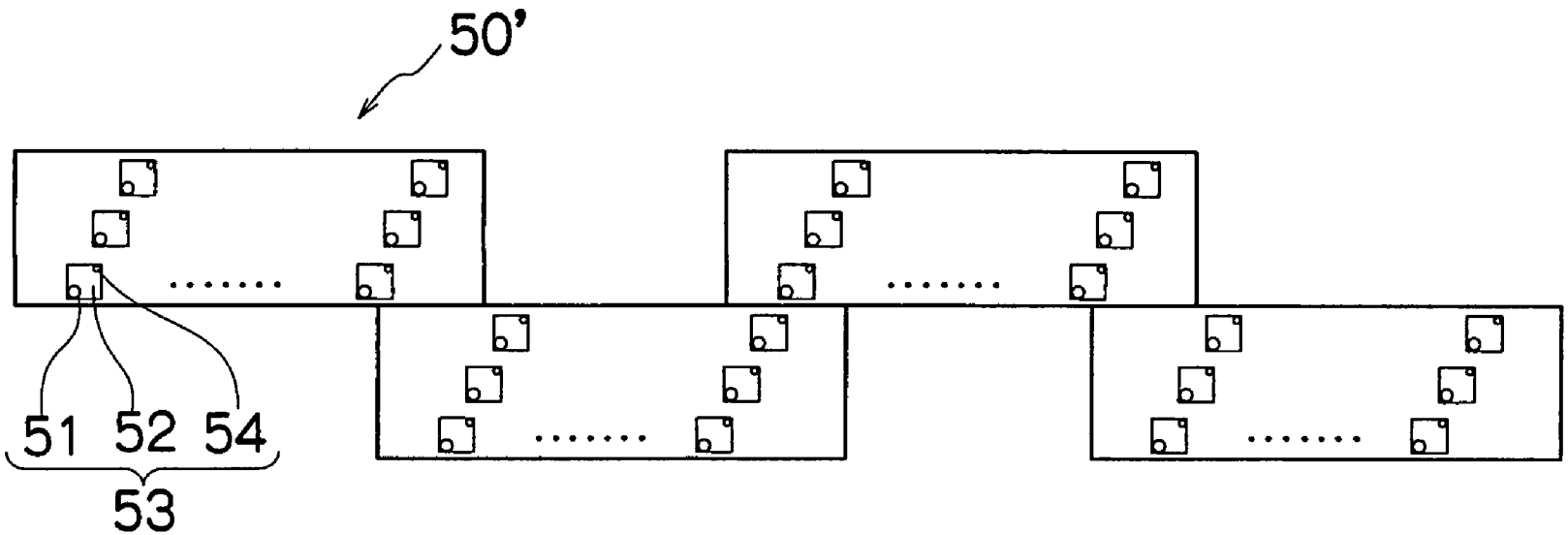
FIG. 3C is a perspective plan view showing another example of the configuration of the print head.
Figure 4:
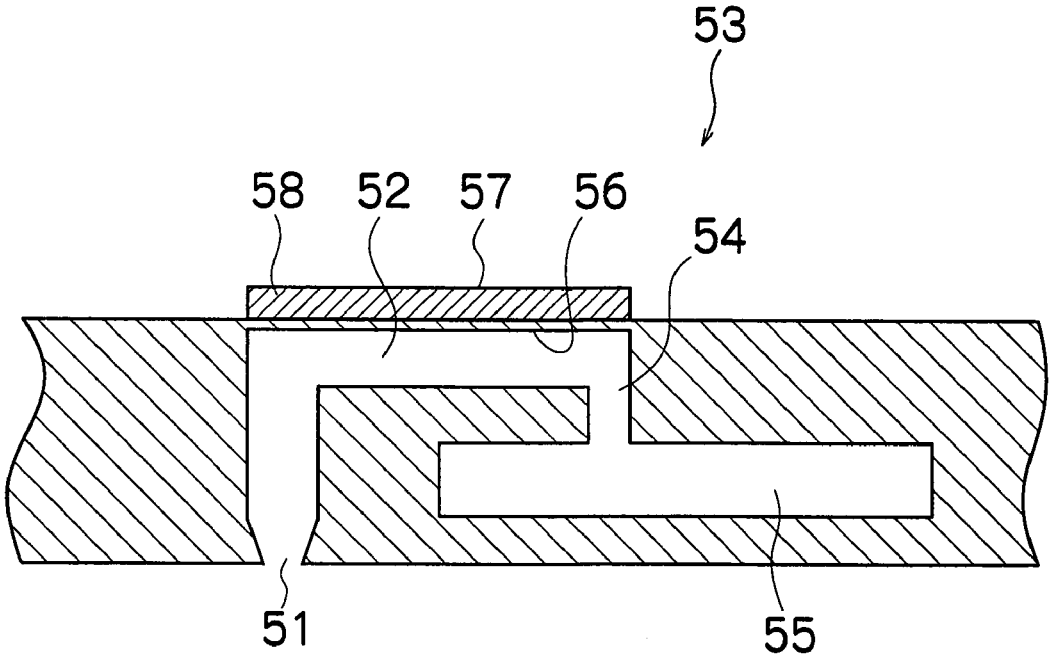
FIG. 4 is a cross-sectional view along a line 4-4 in FIGS. 3A and 3B.

FIG. 3A is a perspective plan view showing an example of the configuration of the print head 50, FIG. 3B is an enlarged view of a portion thereof, FIG. 3C is a perspective plan view showing another example of the configuration of the print head, and FIG. 4 is a cross-sectional view taken along the line 4-4 in FIGS. 3A and 3B, showing the inner structure of an ink chamber unit.

The nozzle pitch in the print head 50 should be minimized in order to maximize the density of the dots printed on the surface of the recording paper. As shown in FIGS. 3A, 3B, 3C and 4, the print head 50 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

Thus, as shown in FIGS. 3A and 3B, the print head 50 in the present embodiment is a full-line head in which one or more of nozzle rows in which the ink discharging nozzles 51 are arranged along a length corresponding to the entire width of the recording medium in the direction substantially perpendicular to the conveyance direction of the recording medium.

Alternatively, as shown in FIG. 3C, a full-line head can be composed of a plurality of short two-dimensionally arrayed head units 50' arranged in the form of a staggered matrix and combined so as to form nozzle rows having lengths that correspond to the entire width of the recording paper 16.

The planar shape of the pressure chamber 52 provided for each nozzle 51 is substantially a square, and the nozzle 51 and an inlet of supplied ink (supply port) 54 are disposed in both corners on a diagonal line of the square. As shown in FIG. 4, each pressure chamber 52 is connected to a common channel 55 through the supply port 54. The common channel 55 is connected to an ink supply tank, which is a base tank that supplies ink, and the ink supplied from the ink tank is delivered through the common flow channel 55 to the pressure chamber 52.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
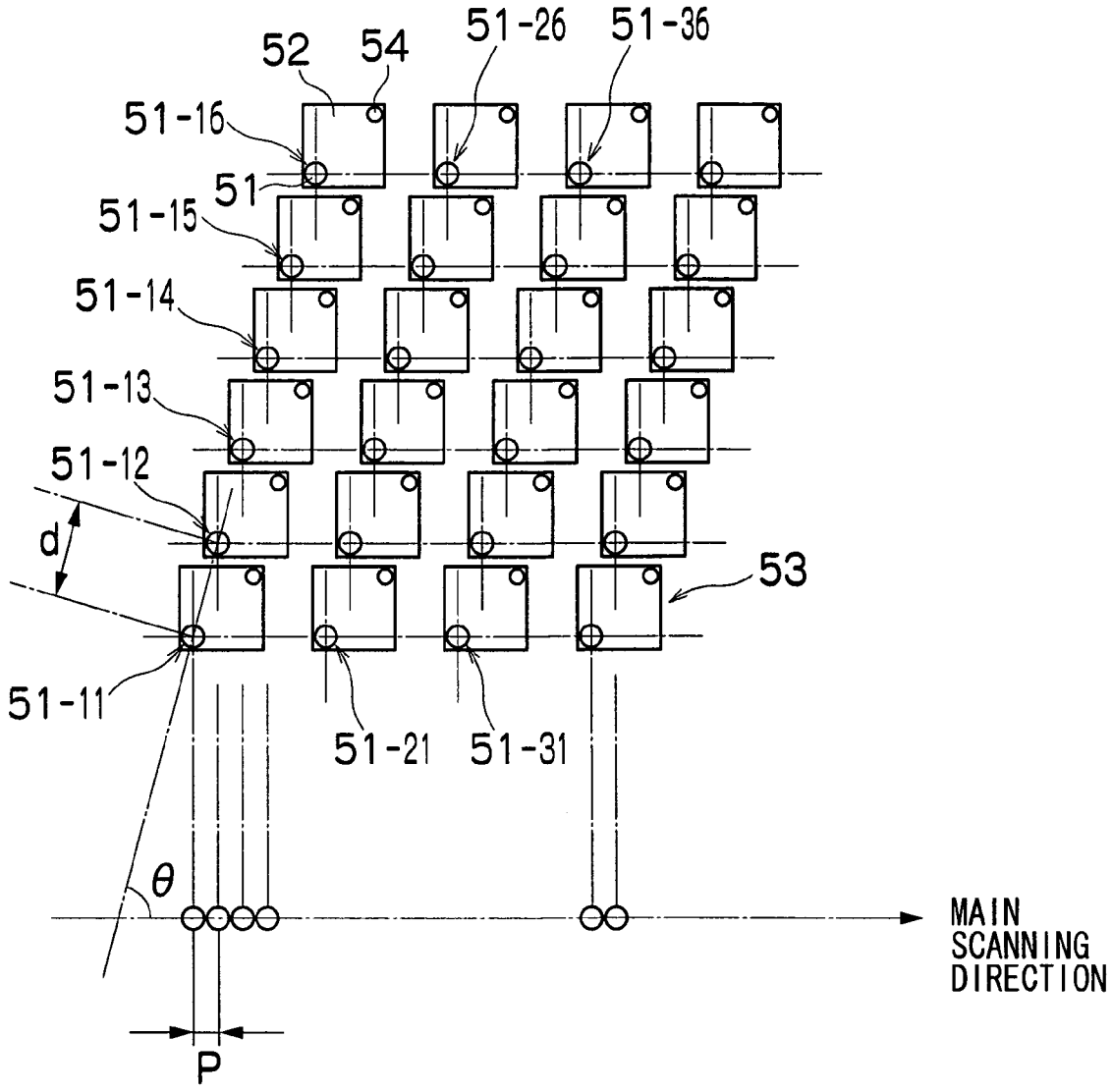
FIG. 5 is an enlarged view showing nozzle arrangement of the print head in FIG. 3A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is d×cos θ.

Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 51 are arranged at regular intervals (pitch P) in a straight line along the lengthwise direction of the head 50, which is parallel with the main scanning direction.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle arrangement is not particularly limited to the examples shown in the drawings. Also, in the present embodiment, a method that ejects ink droplets by deforming the actuator 58 represented by a piezoelectric element is adopted. In the implementation of the present invention, an actuator other than a piezoelectric element may also be used as the actuator 58.

Figure 6:
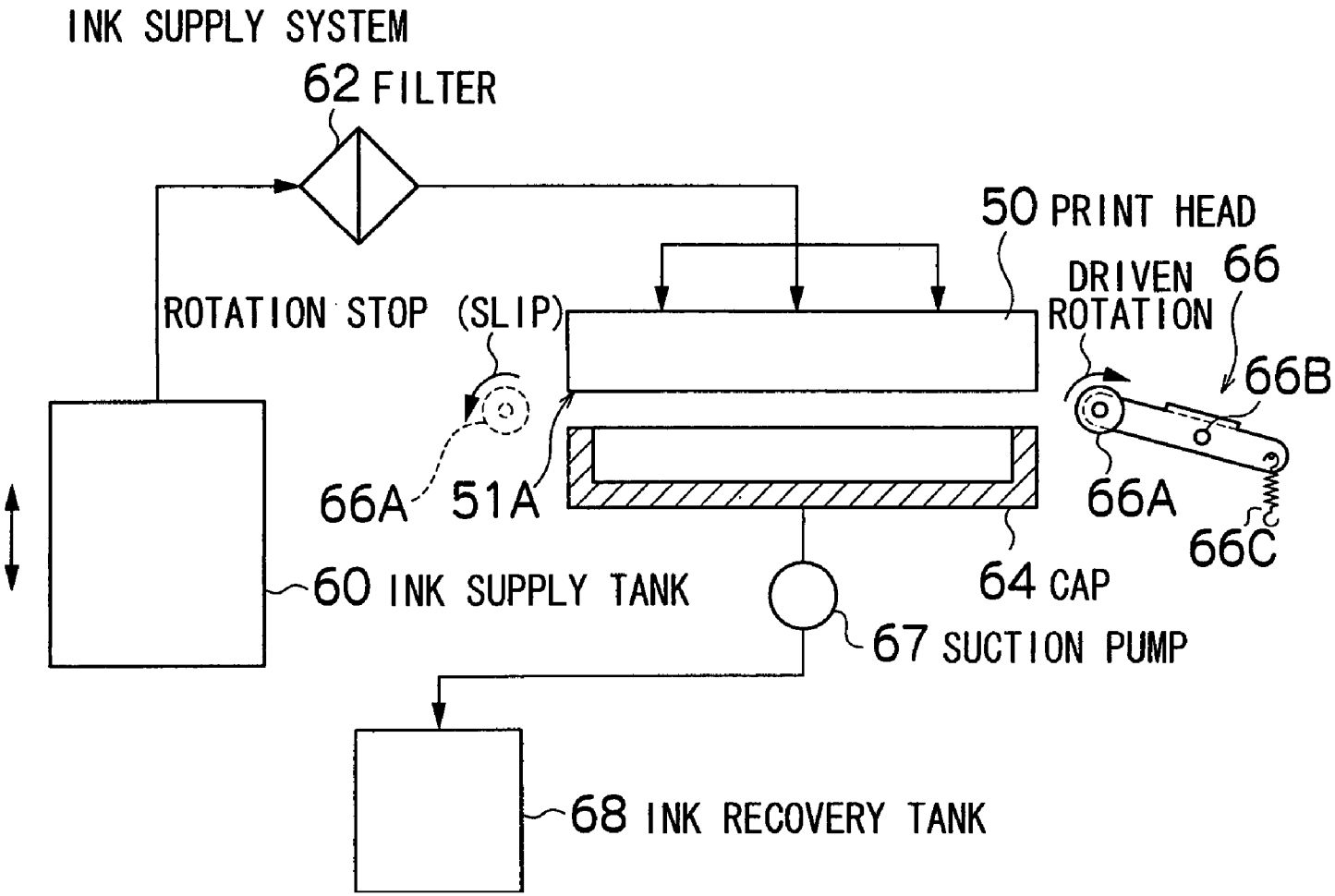
FIG. 6 is a schematic drawing showing a configuration of an ink supply system in the inkjet recording apparatus.

FIG. 6 is a schematic drawing showing the configuration of the ink supply system in the inkjet recording apparatus 10.

An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

Aspects in which the internal pressure is controlled by the sub-tank include aspects in which the internal pressure inside the ink chamber unit 53 is controlled by the difference in ink levels between the sub-tank open to the atmosphere and the ink chamber unit 53 inside the head 51; aspects in which the internal pressures of the sub-tank and ink chamber are controlled by a pump connected to a sealed sub-tank; and the like, and any of these aspects may be used.

The inkjet recording apparatus 10 is also provided with a cap 64 as a device to prevent the nozzle 51 from drying out or to prevent an increase in the ink viscosity in the vicinity of the nozzles, and a nozzle face cleaning device 66 to clean the nozzle face 51A.

A maintenance unit including the cap 64 and the nozzle face cleaning device 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face 51A is thereby covered with the cap 64.

During printing or standby, when the frequency of use of specific nozzles 51 is reduced and a state in which ink is not discharged continues for a certain amount of time or longer, the ink solvent in the vicinity of the nozzle evaporates and ink viscosity increases. In such a state, ink can no longer be discharged from the nozzle 51 even if the actuator 58 is operated.

Before reaching such a state the actuator 58 is operated (in a viscosity range that allows discharge by the operation of the actuator 58), and a preliminary discharge (purge, air discharge, liquid discharge) is made toward the cap 64 (ink receptor) to which the degraded ink (ink whose viscosity has increased in the vicinity of the nozzle) is to be discharged.

Also, when bubbles have become intermixed in the ink inside the print head 50 (inside the pressure chamber 52), ink can no longer be discharged from the nozzle even if the actuator 58 is operated. The cap 64 is placed on the print head 50 in such a case, ink (ink in which bubbles have become intermixed) inside the pressure chamber 52 is removed by suction with a suction pump 67, and the suction-removed ink is sent to an ink recovery tank 68.

This suction action entails the suctioning of degraded ink whose viscosity has increased (hardened) when initially loaded into the head, or when service has started after a long period of being stopped. The suction action is performed with respect to all the ink in the pressure chamber 52, so the amount of ink consumption is considerable. Therefore, a preferred aspect is one in which a preliminary discharge is performed when the increase in the viscosity of the ink is small.

The nozzle surface cleaning device 66 moves while in contact with the ink discharge surface (nozzle surface) 51A of the nozzle 51, and has an ink absorbent roller 66A for removing dirt from the nozzle surface 51A, a support portion 66B for supporting the ink absorbent roller 66A, an urging portion 66C for urging (imparting external force) so that the ink absorbent roller 66A makes contact with the nozzle surface, and a movement mechanism (not depicted) for moving the nozzle surface cleaning device 66 in a relative fashion across the entire width in the main scanning direction of the print head 51. The range of movement of the nozzle surface cleaning device 66 by means of the movement mechanism is not limited to the entire main scanning width of the print head 50 and can be appropriately modified in accordance with the width of the recording paper 16 or in accordance with discharge control.

Figure 8:
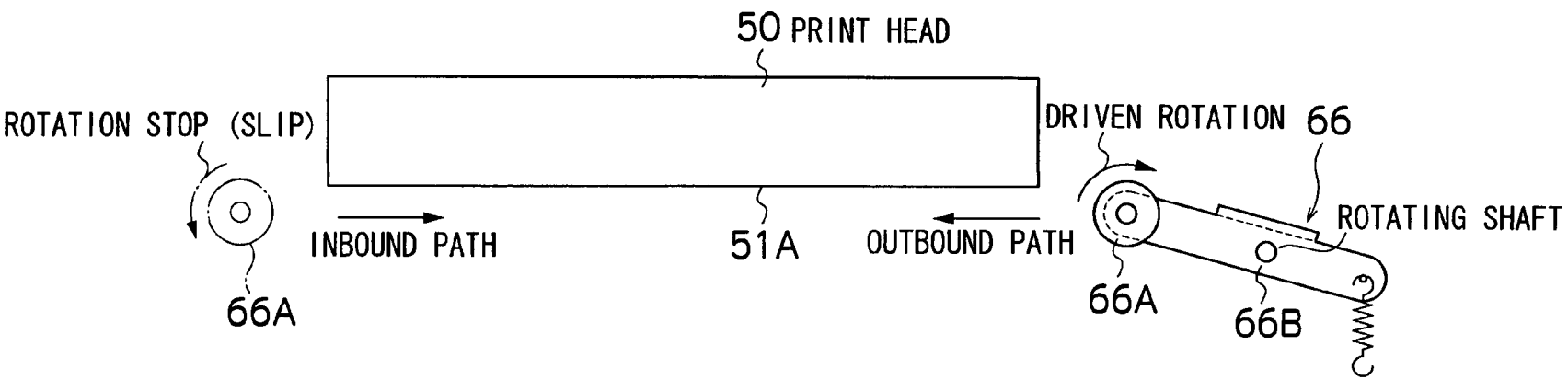
FIG. 8 is a schematic structural drawing of the nozzle surface cleaning device of the inkjet recording apparatus.

In the urging portion 66C, spring force or another elastic force may act on the support portion 66B (force point), as shown in FIG. 8, and the elastic force may be exerted on the ink absorbent roller 66A (operation point), with the rotating shaft shown in FIG. 8 as a supporting point. Aspects in which external force is imparted from the urging portion 66C to the nozzle surface 51A is not limited to this option alone, and various aspects are applicable as long as a uniform force is applied between the nozzle surface 51A and the ink absorbent roller 66A (operation point).

When ink droplets, paper dust or the like from the recording paper 16 deposit on the nozzle surface 51A, the nozzle surface 51A is wiped and the nozzle surface 51A is cleaned by moving the ink absorbent roller 66A along the nozzle surface 51A. When dirt on the ink discharge surface is cleaned by the blade mechanism, a preliminary discharge is carried out in order to prevent foreign matter from being mixed inside the nozzle 51 by the blade. The details of the nozzle surface cleaning device 66 are described hereinafter.

Figure 7:
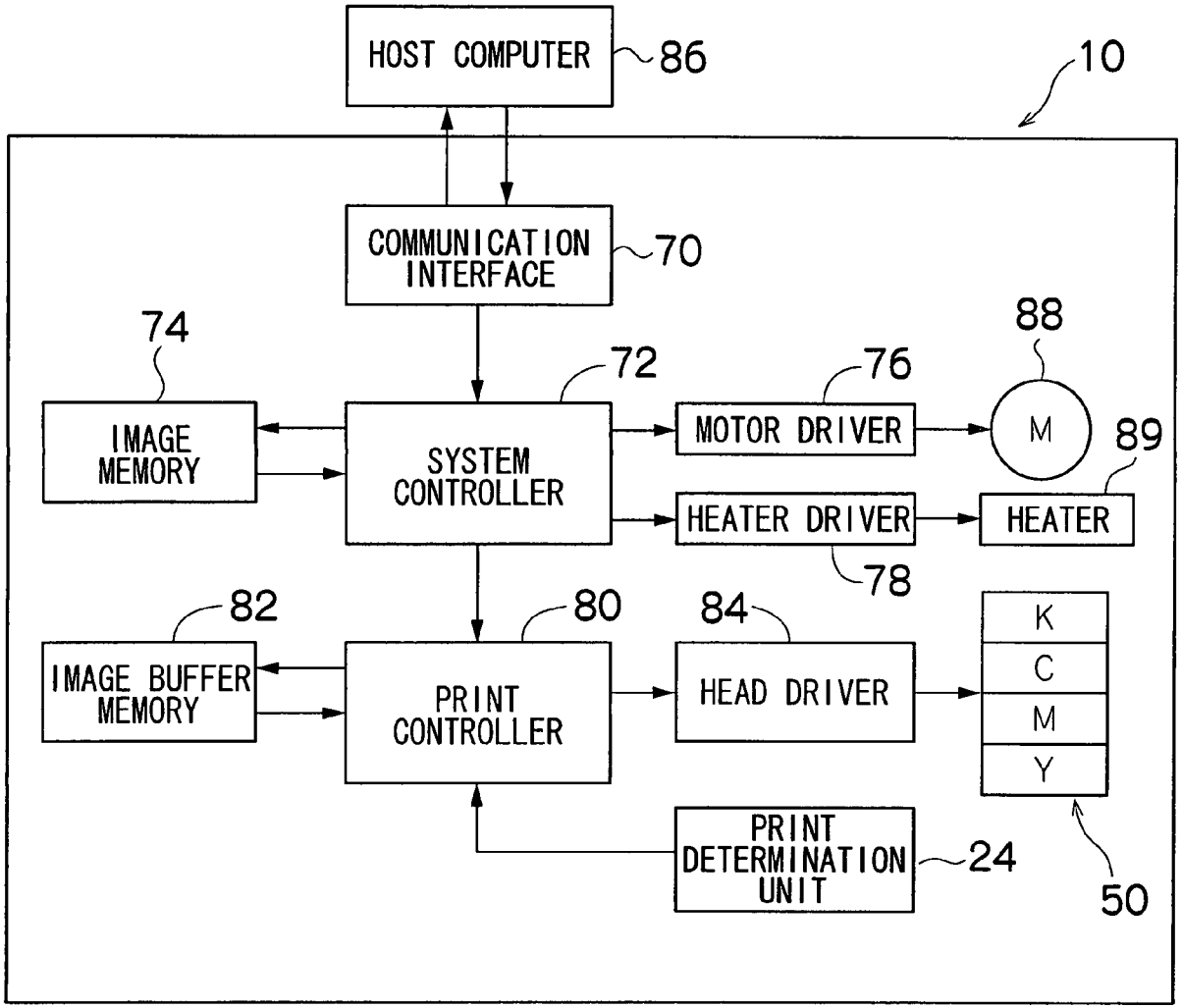
FIG. 7 is a block diagram of principal components showing a system configuration of the inkjet recording apparatus.

FIG. 7 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a heater 89 and the motor 88 in the conveyance system.

The motor driver (drive circuit) 76 drives the motor 88 in accordance with commands from the system controller 72. The motor driver 76 and motor 88 alone are shown in FIG. 7, but the system controller 72 controls a plurality of motor drivers and motors.

Examples include motors having a movement mechanism for moving the maintenance unit shown in FIG. 6, motors having a movement device for the nozzle surface cleaning device 66, and other motors. There are a variety of other motors, and these motors (motor drivers) are controlled by the system controller 72.

The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12C, 12M, and 12Y of the respective colors on the basis of the print data received from the print controller 80. A feedback control system for keeping the drive conditions for the print heads constant may be included in the head driver 84.

Nozzle Surface Cleaning

The nozzle surface 51A is rendered water repellent in order to have uniform wettability. A possible aspect is one in which a treatment layer (treatment film) is formed by a predetermined water-repellent treatment with a fluorine-based compound, a silicon-based compound, or the like, but other water-repellent treatments may also be used.

Immediately after discharge, ink droplets, chemical solutions, or other droplets may adhere to the nozzle surface 51A, and when these droplets are present in the vicinity of the openings of the nozzles 51, droplets deposited on the nozzle surface 51A and droplets discharged from the nozzles 51 attract each other due to surface tension, generating a curvature in the discharge direction (flight direction) of the ink droplet discharged from the nozzle 51.

When the droplets deposited on the nozzle surface 51A make contact with the print image, the print image may be directly stained.

On the other hand, ink has a characteristic whereby glycerin, alcohol, and other high-boiling components dehydrate when contact is made with the atmosphere, and a thickened layer is formed as the viscosity gradually increases. Therefore, in a nozzle that has not discharged for a long period of time, the viscosity of the ink increases in the vicinity of the discharge opening area, and the thickened ink becomes the cause of discharge defects. Moisture evaporates from the droplets deposited on the nozzle surface 51A, and the ink may solidify.

When ink deposited on the nozzle surface 51A solidifies or paper dust or the like from the recording paper 16 deposits on the nozzle surface 51A, this may cause image degradation and discharge defects in the nozzle 51, so the nozzle surface 51A must be regularly cleaned by the nozzle surface cleaning device 66.

Next, the nozzle surface cleaning device 66 for removing dirt deposited on the nozzle surface 51A is described with reference to FIG. 8.

The nozzle surface cleaning device 66 has an ink absorbent roller 66A, a support portion 66B, an urging portion 66C, a movement mechanism (not depicted), and the like, as shown in FIGS. 6 and 8.

The ink absorbent roller 66A has a width that is greater than the width of the print head 50 in the sub-scanning direction, and can clean the entire area of the nozzle surface 51A with a single movement in the main scanning direction. It is apparent that a configuration is also possible in which the width of the ink absorbent roller 66A is made smaller than the width of the print head 50 in the sub-scanning direction, and the nozzle surface cleaning device 66 (ink absorbent roller 66A) and the print head 50 are allowed to move in relation to each other in the sub-scanning direction. When there is a plurality of print heads 50, a nozzle surface cleaning device 66 may be provided for each print head, or a single nozzle surface cleaning device 66 may be provided for the plurality of print heads.

The ink absorbent roller 66A is composed of a porous material, and droplets deposited on the nozzle surface 51A can be absorbed through osmotic pressure. The material of the ink absorbent roller 66A is a combination of a porous urethane material and a hydrophilic material, porous expanded rubber or the like may be used, and the rubber hardness is preferably 10° to 30°.

The movement mechanism (not depicted) has a conveyance device for conveying the nozzle surface cleaning device 66 by using a ball screw or belt, a motor for driving the is conveyance device, the guide or other support member for supporting the nozzle surface cleaning device 66 during conveyance, and other components. Conveyance control in which these components are used is performed by the system controller shown in FIG. 7.

Figure 9:
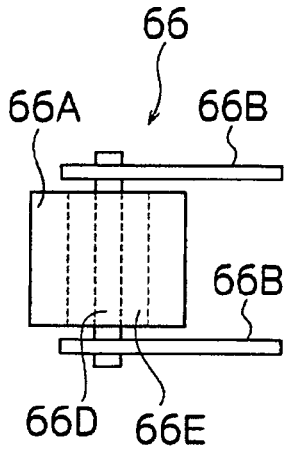
FIG. 9 is a schematic drawing of the ink-absorbing roller of the nozzle surface cleaning device shown in FIG. 8.

The ink absorbent roller 66A is rotatably configured with the roller rotating shaft 66D as the shaft, as shown in FIG. 9, and the ink absorbent roller 66A is rotatably driven clockwise when the nozzle surface cleaning device 66 moves while causing the ink absorbent rollers 66A to be in contact with the nozzle surface 51A in the outbound direction shown in FIG. 8.

On the other hand, the ink absorbent roller 66A and the roller rotating shaft 66D are linked by way of a one-way clutch mechanism 66E, and when the nozzle surface cleaning device 66 moves in the inbound direction, the roller 66A is not rotatably driven but is caused to slide (slip) on the nozzle surface 51A as it moves, wiping away the deposit on the nozzle surface 51A. Instead of the one-way clutch mechanism 66E, it is also possible to provide a driven load imparting device for imparting a driven load to the ink absorbent roller 66A in the inbound path, or a power transmitting device that causes the ink absorbent roller 66A to rotate in the direction opposite to the driven rotation.

The movement mechanism (not depicted) is controlled so that the outbound and inbound paths pass through the same areas of the nozzle surface 51A; a liquid-absorbing step and a deposit wiping step of wiping away deposits that cannot be removed in the liquid-absorbing step can be performed in a single reciprocating movement; and the cleaning time can be reduced.

Rolling friction is generated between the nozzle surface 51A and the ink absorbent roller 66A in the outbound path (liquid-absorbing step), so friction between the treatment layer of the nozzle surface 51A and the ink absorbent roller 66A can be reduced.

In the inbound path (wiping step), the ink absorbent roller 66A absorbs liquids during movement in the outbound path, and the ink absorbent roller 66A is moistened. The nozzle surface 51A is also moistened to a certain extent. In this condition, moisture is interposed between the nozzle surface 51A and the ink absorbent roller 66A, and wet wiping can be performed. Therefore, friction on the treatment layer of the nozzle surface 51A can be reduced, and because moisture is imparted to the deposits deposited on the nozzles surface 51A, the deposit is more easily removed.

Figure 10:
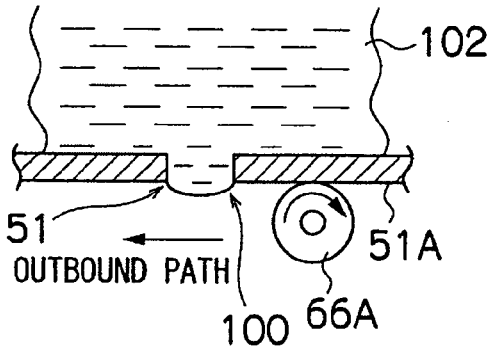
FIG. 10 is drawing describing the meniscus control of the nozzle surface cleaning device shown in FIG. 8.

An aspect in which higher viscosity matter (thickened ink) formed on the meniscus 100 surface is removed will be described next by using FIG. 10. FIG. 10 is a schematic cross-sectional drawing of the nozzle 51.

Since the surface of the meniscus 100 is exposed to the atmosphere, moisture evaporates, and hence the ink near the meniscus surface of the ink 102 loaded into the nozzle 51 gradually increases in viscosity. The ink with increased viscosity is difficult to discharge from the nozzle 51, and when the viscosity increases further, discharge cannot be performed. A preliminary discharge (liquid discharge) or the like is normally performed in order to remove this thickened ink.

The thickened ink on the meniscus 100 surface can be removed by means of the nozzle surface cleaning device 66, as shown in FIG. 8.

First, the pressure inside of the print head 50 (nozzle 51) is raised, and the meniscus 100 is controlled so that the meniscus 100 is convex toward the outside, as shown in FIG. 10. When the ink absorption roller 66A comes into contact with the surface of the meniscus 100 in this condition, the thickened ink of the meniscus 100 is absorbed into the ink absorption roller 66A by the osmotic pressure of ink absorption roller 66A, and the thickened ink is removed from the surface of the meniscus 100.

In the inbound path (wiping step), ink leakage from nozzle 51 in the wiping step can be prevented by keeping the shape of the meniscus concave, and the consumption of ink be reduced. The control that keeps the shape of the meniscus concave is performed in the normal print standby state.

The aspect in which the internal pressure of the print head 50 is increased may be brought about by changing the level in the ink supply tank 60 shown in FIG. 6 to raise the internal pressure, or by using an ink supply pump to increase the pressure. The pressure may also be increased by controlling the actuator 58 shown in FIG. 4.

In an aspect in which the meniscus 100 is controlled by controlling the actuator 58 shown in FIG. 4, for example, control of the meniscus 100 is performed in the print controller 80 shown in FIG. 7. In other words, the printer controller 80 is used as a device for controlling both the ink discharge and the meniscus 100.

According to this configuration, the meniscus controller (meniscus control device) for controlling the meniscus 100 is constituted by the print controller 80 shown in FIG. 7 (a waveform forming part not depicted in the drawings which is provided in the print controller 80), the head driver 84, the pressure chamber 52 shown in FIG. 4 and provided in the print head 50, the actuator 58 provided on the pressure plate 56, which forms the ceiling of the pressure chamber 52, and so on.

To remove thickened ink from the vicinity of the meniscus 100 by the above-described configuration, a driving waveform is formed using the waveform forming part of the print controller 80 to operate the actuator 58 such that the pressure chamber 52 is swung in a liquid expulsion direction, and this driving waveform is applied to the head driver 84. The nozzle surface cleaning device 66 shown in FIG. 6 is caused to contact the meniscus 100 of the corresponding nozzle 51 in synchronization with the operation of the actuator 58, thereby removing the thickened ink from the surface of the meniscus 100.

Figure 14:
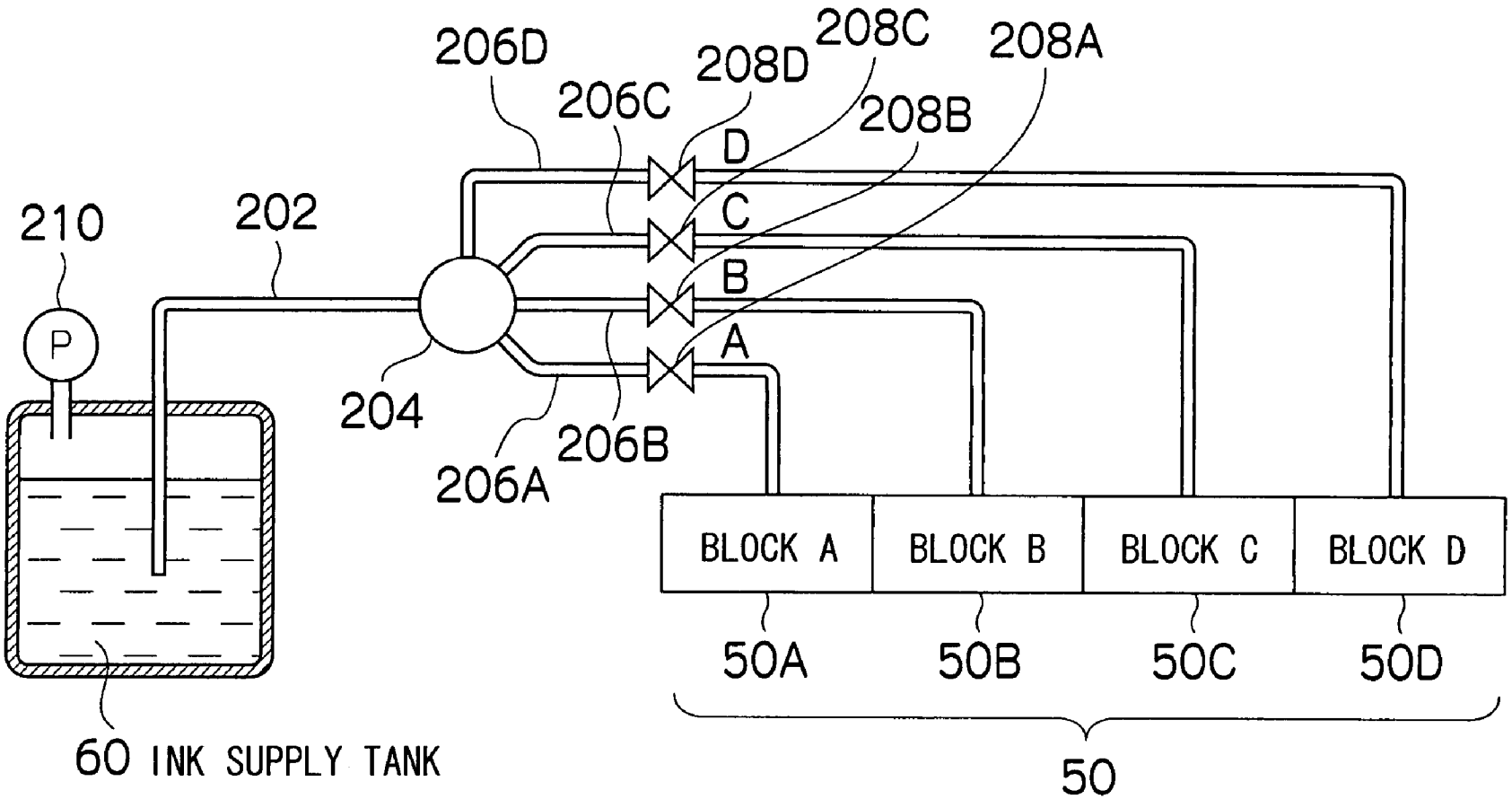
FIG. 14 is a schematic diagram showing the configuration of an aspect in which meniscus control is performed by controlling the internal pressure of the ink supply system.

FIG. 14 shows an aspect according to which the internal pressure (back pressure) in the ink supply path, including the ink supply tank 60 shown in FIG. 6, is controlled to positive pressure in order to set the meniscus 100 in a convex shape protruding toward the outside of the nozzle 51.

In this aspect, the print head 50 is divided into four blocks 50A, 50B, 50C and 50D, and the print head block that is to control the meniscus 100 can be selected from among the print head blocks 50A to 50D.

As shown in FIG. 14, the ink supply tank 60 and the print head blocks 50A to 50D are linked by passages constituted by a main supply path 202, a dividing part 204, and branch supply paths 206A, 206B, 206C and 206D. The passages can be opened and closed by valves 208A, 208B, 208C and 208D provided on the branch supply paths 206A to 206D, respectively.

In other words, each of the passages between the print head blocks 50A to 50D to be used for removing the thickened ink from the surface of the meniscus 100 and the ink supply tank 60 is opened by selectively opening each of the valves 208A to 208D, whereupon a micro-pump 210 provided in the ink supply tank 60 is used to pressurize the ink, enabling the back pressure of the desired print head block to be set to positive pressure.

In the aspect shown in FIG. 14, the print head 50 is divided into four blocks, but it may be divided into more than four or less than four blocks in accordance with the capability of the micro-pump 210.

The valves 208A to 208D shown in FIG. 14 are controlled to open and close by the system controller 72 (or the print controller 80) shown in FIG. 7.

In addition to the aspects described above, the internal pressure can be controlled with a sub-tank (not depicted) described with reference to FIG. 6. When changing the level of the sub-tank (not depicted) or the supply tank 60, a movement mechanism that moves tanks up and down is provided.

The movement mechanism has a guide or another support portion that supports a conveyance portion for moving the ink supply tank 60 (sub-tank), a motor (motor driver) for driving the conveyance portion, and an ink supply tank 60 (sub-tank), and these are controlled by the system controller shown in FIG. 7.

In the aspect for controlling the internal pressure, the amount of displacement of the meniscus 100 can be increased in comparison with the aspect in which the actuator is controlled. Either one of these aspects may be used, or they may be used in combination.

The present example is described with reference to a case in which the meniscus 100 is controlled to cause the surface of the meniscus 100 to protrude out from the nozzle, but the shape of the meniscus 100 may be a convex shape on the outside of the nozzle 51 and does not need two protrude from the opening of the nozzle 51.

As long as the roller material is soft so as to slightly enter into the nozzle 51 when the ink absorbent roller 66A is pressed to the nozzle surface 51A, the thickened ink formed on the surface of the meniscus 100 can be controlled without controlling the meniscus 100, depending on the state (viscosity) of the meniscus 100 surface, but when the step of removing liquid by absorption into the above cleaning of the nozzle surface 51A and the removal of the thickened ink on the surface of the meniscus 100 are performed in a synchronous fashion, the cleaning of the nozzle surface 51A and the removal of the thickened ink on the surface of the meniscus 100 can be performed with good efficiency.

Figure 11:
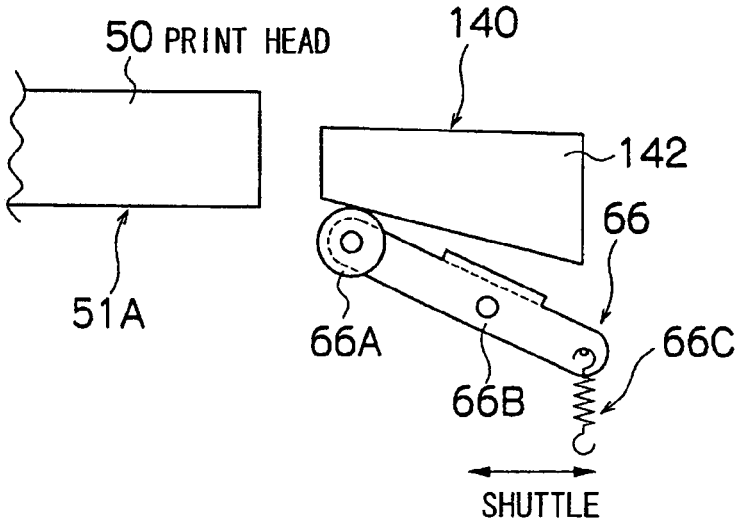
FIG. 11 is a drawing describing the recovery device of the nozzle surface cleaning device shown in FIG. 8.

FIG. 11 shows the recovery device (wringing mechanism) 140 for absorbing ink into the ink absorbent roller 66A and recovering ink or the like drawn up into the roller.

The nozzle surface cleaning device 66 performs a single reciprocating action across the entire width of the print head in the main scanning direction, and when the single cleaning step is completed, the ink and other liquids that saturate the ink absorbent roller 66A are recovered.

The recovery device 140 is provided with an ink absorber 142 whose osmotic pressure is higher than ink absorption roller 66A. The device moves while pressing the ink absorption roller 66A to the surface of the ink absorber 142, and the ink and the like drawn up into the ink absorption roller 66A are absorbed by the ink absorber. The ink recovered into the ink absorber 142 is recovered into a waste ink tank (not depicted). The waste ink tank can double as the ink recovery tank 68 shown in FIG. 6.

When a sloping surface is provided to the ink absorbent roller 142, as shown in FIG. 11, and the ink absorbent roller 66A is moved along the sloping surface while being pressed to the sloping surface, the effect of moving the ink to the ink absorber 142 can be improved. A preferred aspect in one in which the recovery device 140 is stored in the maintenance unit described in FIG. 6.

The control flow of the above nozzle surface cleaning device 66 is as follows.

When the step of cleaning the nozzle surface 51A is initiated, the nozzle surface cleaning device 66 is set at a prescribed initial position, and the print head 50 is initialized (initialization step).

The ink absorbent roller 66A is thereafter brought into contact with the nozzle surface 51A, and the nozzle surface cleaning device 66 moves in the outbound direction shown in FIG. 8 as the ink absorbent roller 66A is rotatably driven. At this time, the liquid ink and other droplets deposited on the nozzle surface 51A are absorbed by the ink absorbent roller 66A, and the ink droplets are removed from the nozzle surface 51A (liquid absorbing step).

When the nozzle surface cleaning device 66 completes its movement over the entire width of the print head 50 in the main scanning direction, the one-way clutch mechanism 66E makes a switch (switching step) and the nozzle surface cleaning device 66 begins to move in the direction of the inbound path.

In the inbound path, the ink absorbent roller 66A is fixed to the roller rotating shaft 66D and is caused to move across the nozzle surface 51A while slipping (wiping step).

When a single reciprocating movement is carried out over the entire width of the print head 50, the nozzle surface cleaning device 66 moves to the waste ink recovery position to recover the ink in the ink absorbent roller 66A and the deposits on the surface of the ink absorbent roller 66A (recovery step). When the recovery step is completed, the next cleaning step may be performed.

Figure 15:
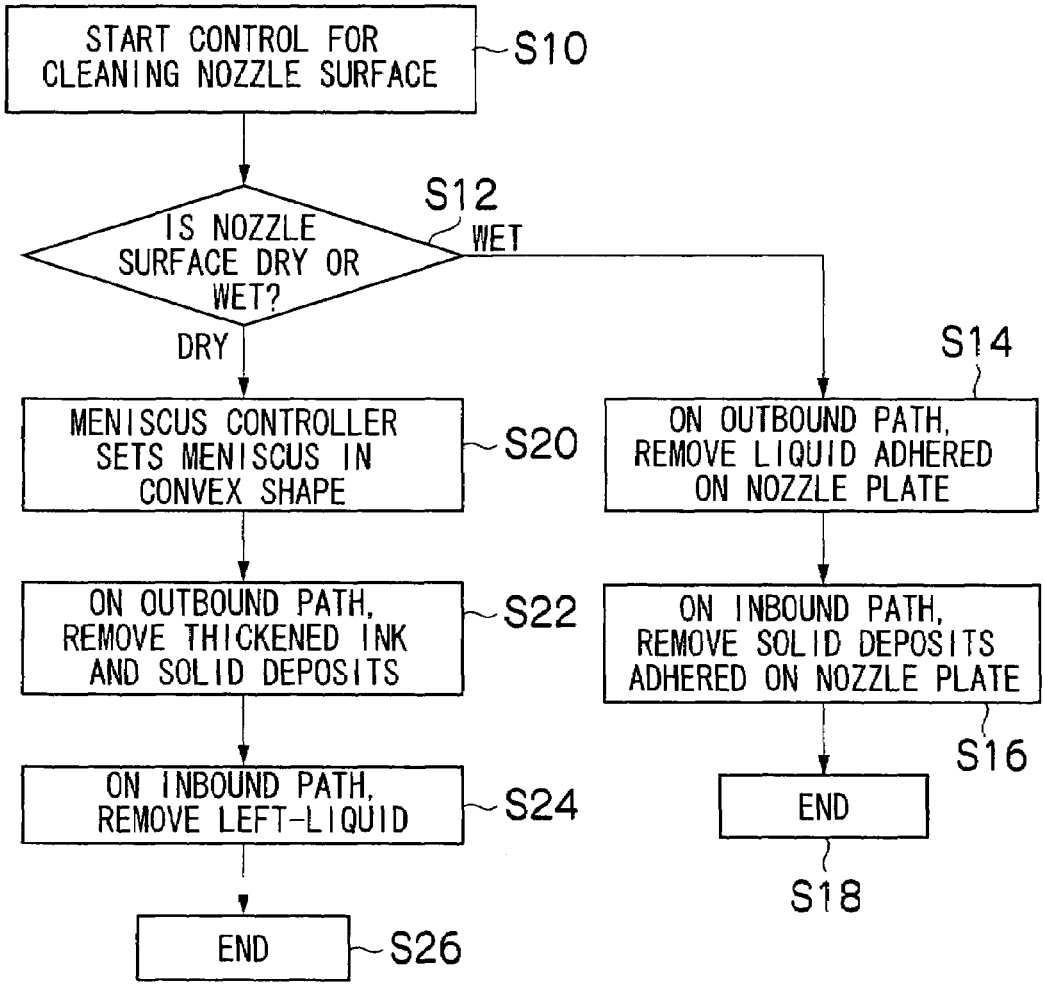
FIG. 15 is a flowchart showing the flow of nozzle surface cleaning control.

FIG. 15 is a flowchart showing the flow of control to switch the ink absorbent roller 66A between the liquid absorbing step and the wiping step.

When cleaning of the nozzle surface 51A begins (step S10), a determination is made as to whether the nozzle surface 51A is in a wet condition or in a dry condition (step S12). In step S12, a sensor such as a CCD may be used to observe the nozzle surface directly, or the condition of the nozzle surface 51A may be determined indirectly from the state of nozzle discharge control, the temperature of the nozzle surface, and so on.

When it is determined in step S12 that the nozzle surface 51A is wet, the liquid ink on the nozzle surface is removed by absorption as the ink absorbent roller 66A is driven to rotate on the outbound path (step S14). Then, solid deposits are wiped from the nozzle surface 51A as the ink absorbent roller and the nozzle surface 51A are caused to slip on the inbound path (step S16), after which cleaning of the nozzle surface 51A ends (step S118).

If, on the other hand, it is determined in step S12 that the nozzle surface 51A is dry, meniscus control is performed to set the meniscus 100 in a convex shape protruding to the outside of the nozzle 51 (step S20), whereupon thickened ink formed on and near the surface of the meniscus 100 is removed (step S22). In step S22, the wiping as described in step S16 is performed. More specifically, thickened ink on and near the surface of the meniscus 100 and solid deposits adhered to the nozzle surface 51A are removed as the ink absorbent roller 66A and the nozzle surface 51A are caused to slip. Then, on the inbound path, the ink absorbent roller 66A is driven to rotate to remove the liquid ink (mist) that was not wiped away on the outbound path (step S24), after which cleaning of the nozzle surface 51A is complete (step S26).

Figure 16:
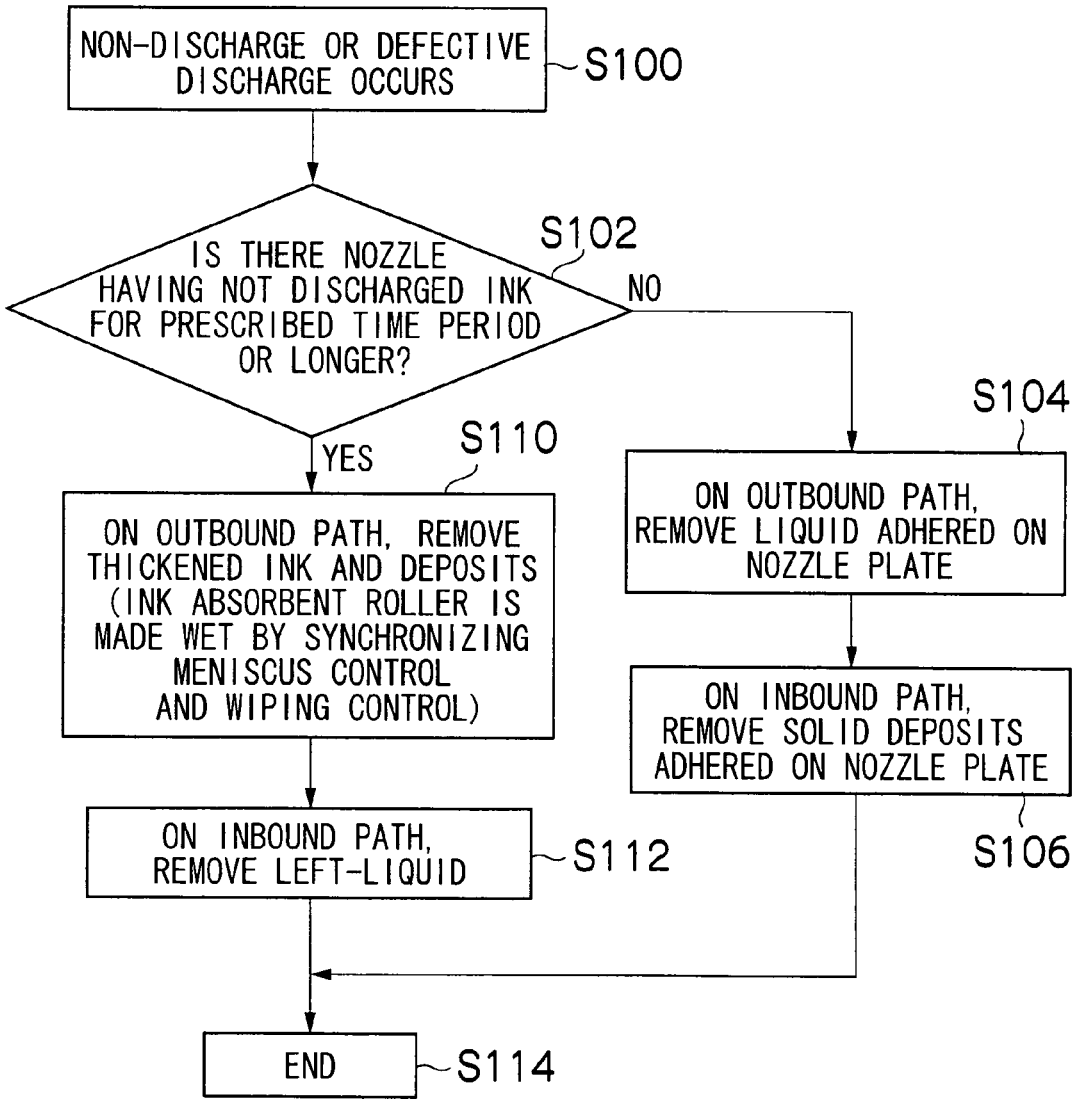
FIG. 16 is a flowchart showing another aspect of the nozzle surface cleaning control.

By combining the nozzle surface cleaning procedure and the nozzle discharge defect detection described above, the maintenance performance of the print head 50 can be further improved. FIG. 16 is a flowchart showing the flow of control in an aspect combining the nozzle surface cleaning control and the nozzle discharge defect detection control described above.

When non-discharge or defective discharge occurs and is detected during printing or a printing interval (step S100), a determination is made in the print controller 80 shown in FIG. 7 as to whether any of the nozzles has not discharged ink for a prescribed time period or longer (step S102).

If, in step S102, there is no nozzle which has not discharged ink for the prescribed time period or longer (a NO determination), ink on the nozzle surface 51A is removed on the outbound path by driving the ink absorbent roller 66A to rotate (step S104).

The ink absorbent roller 66A is also driven to rotate on the inbound path to remove liquid ink that was not wiped away on the outbound path (step S106), after which cleaning of the nozzle surface 51A is complete (step S114).

A possible cause of a discharge defect (discharge fault) in the nozzle that has discharged ink within the prescribed time period is a defect in the water repellency of the nozzle surface 51A. Specific examples of water repellency defects include ink mist adhered to the nozzle surface 51A and so on.

Since the prescribed time period (the drying time of the ink) has not elapsed, the nozzle surface 51A is in a wet condition. Hence, control is performed such that on the outbound path, the ink absorbent roller 66A is driven to rotate to remove the ink mist adhered to the nozzle surface 51 by absorption, and on the inbound path, the ink absorbent roller 66A and the nozzle surface 51A are caused to slip (in a non-rotating condition) in order to remove solid deposits adhered to the nozzle surface 51A.

If, on the other hand, it is determined in step S102 that there is the nozzle that has not discharged ink for the prescribed time period or longer (a YES determination), the meniscus 100 is controlled to form a convex shape protruding to the outside of the nozzle 51, and the ink absorbent roller 66A and the nozzle surface 51A are caused to slip on the outbound path in order to remove thickened ink from the vicinity of the meniscus 100 and solid deposits adhered to the nozzle surface 51A (step S110).

In other words, in the nozzle that has not discharged ink for the prescribed time period or longer, the ink inside the nozzle thickens, causing solid deposits to develop on the nozzle surface 51A, which makes a discharge defect more likely to occur. Hence the meniscus 100 is controlled into a convex shape protruding to the outside of the nozzle 51 and the ink absorbent roller 66A is moved to remove the thickened ink from the surface of the meniscus 100. If the ink absorbent roller 66A and the nozzle surface 51A are caused to slip at this time in order to improve the wiping effect on the nozzle surface 51A, the removal performance for thickened ink in the nozzle 51 and solid deposits adhered to the nozzle surface 51A can be improved.

On the inbound path, the ink absorbent roller 66A is driven to rotate to remove the ink that was not wiped away on the outbound path (step S112).

When the outbound step of step S112 is complete, cleaning of the nozzle surface 51A ends (step S114).

Here, the prescribed time period denotes an amount of time up to the point at which the viscosity of the ink has increased (the ink has dried) to such an extent that ink cannot be discharged from the nozzle 51 in a favorable condition. The prescribed time period differs according to the environmental temperature (peripheral temperature) of the print head 50, the ink type, and so on, and it is therefore preferable to prepare a plurality of values in advance and switch between these values in accordance with the environment and ink type.

In the inkjet recording apparatus 10 with the above configuration, the nozzle surface cleaning device 66 reciprocates across the entire width of the print head 50 in the main scanning direction, the droplets are removed in the outbound path (liquid absorbing step), and the deposits are removed in the inbound path (wiping step). Friction between the nozzle surface 51A and the ink absorbent roller 66A can be reduced by rotatably driving the ink absorbent roller 66A in the outbound path and by performing wet wiping in the inbound path. Because there is no dry wiping (scraping) action, the durable time span of the nozzle surface 51A is extended.

Deposits are removed with the ink absorbent roller 66A in a moistened state and with a driven load applied, so the operation can be performed using wet wiping and the deposits can be reliably removed.

The present embodiment is one in which a single ink absorption roller 66A is made to reciprocate, and any liquids and deposits on the nozzle surface 51A are removed, but also possible is a configuration in which an ink absorbent roller and a wiping roller are separately provided, the roller is operated in one direction, and liquids and deposits are removed by their respective rollers. A preferable aspect in such a case is one in which a moistening device is provided for moistening at least the wiping roller. The moistening device can be realized with an aspect in which deposits are removed by the wiping roller after the ink has been absorbed away by the ink absorbent roller.

It is possible to control the meniscus 100 and to absorb away the thickened ink formed on the surface of the meniscus 100 with the aid of the ink absorbent roller 66A, so the nozzles 51 can be restored synchronously with the cleaning of the nozzle surface 51A without relying on suction and liquid discharge from the nozzles 51. The maintenance time and the amount of ink consumed can be reduced.

Next, a modified example of the nozzle surface cleaning device 66 is described with reference to FIG. 12. In the present modified example, a blade is used in lieu of the rotatably driven ink absorbent roller 66A.

The nozzle surface cleaning device 150 has an ink absorbent blade 152, a deposit removal blade 154, and a movement mechanism (not depicted) that allows the nozzle surface cleaning device 150 to move in a reciprocating manner across the entire width of the print head 50 in the main scanning direction of the print head 50. Also provided is a blade movement mechanism (not depicted) that brings the ink absorbent blade 152 and the deposit removal blade 154 into contact with the nozzle surface 51A, and separates these from the nozzle surface 51A.

The ink absorption blade 152 and deposit removal blade 154 have a width that is greater than the width of the print head 50 in the sub-scanning direction, and the blades move in the main scanning direction across the entire width of the print head 50, so the entire area of the nozzle surface 51A can be cleaned.

Used in the ink absorption blade 152 is a material that has low sliding frictional resistance with the nozzle surface 51A and that removes liquids and deposits from the nozzle surface 51A. A material that removes the deposits on nozzle surface 51A by wiping (scraping) is used in the deposit removal blade 154. The ink absorption blade 152 is preferably composed of porous rubber or another low-hardness foam material, and the deposit removal blade 154 is preferably composed of polyurethane rubber or another rubber material with intermediate hardness.

The nozzle surface cleaning device 150 cleans the nozzle surface 51A while moved in a reciprocating fashion across the entire width of the print head 50 in the main scanning direction, in the same manner as the nozzle surface cleaning device 66 shown in FIG. 8. The surface of the meniscus 100 is controlled so as to form a convex shape on the external side as shown in FIG. 10, thickened ink on the surface of the meniscus 100 is removed using the ink absorbent blade 152, the surface of the deposit removal blade 154 that is in contact with the nozzle surface 51A is moistened so as to avoid dry wiping, and the frictional resistance between the nozzle surface 51A and the deposit removal blade 154 can be reduced.

First, the ink absorbent blade 152 is brought into contact with the nozzle surface 51A, any liquid deposited on the nozzle surface 51A and thickened ink on the surface of the meniscus 100 are removed by absorption in the outbound path, the deposit removal blade 154 is brought into contact with the nozzle surface, and the deposit on the nozzle surface 51A is removed by wet wiping.

Also possible is an aspect in which ink is absorbed in the liquid absorbing step at a slight clearance between the nozzle surface 51A and the ink absorbent blade 152, and the deposit removal blade 154 is brought into contact with the nozzle surface 51A in the deposit removal step.

Figure 12:
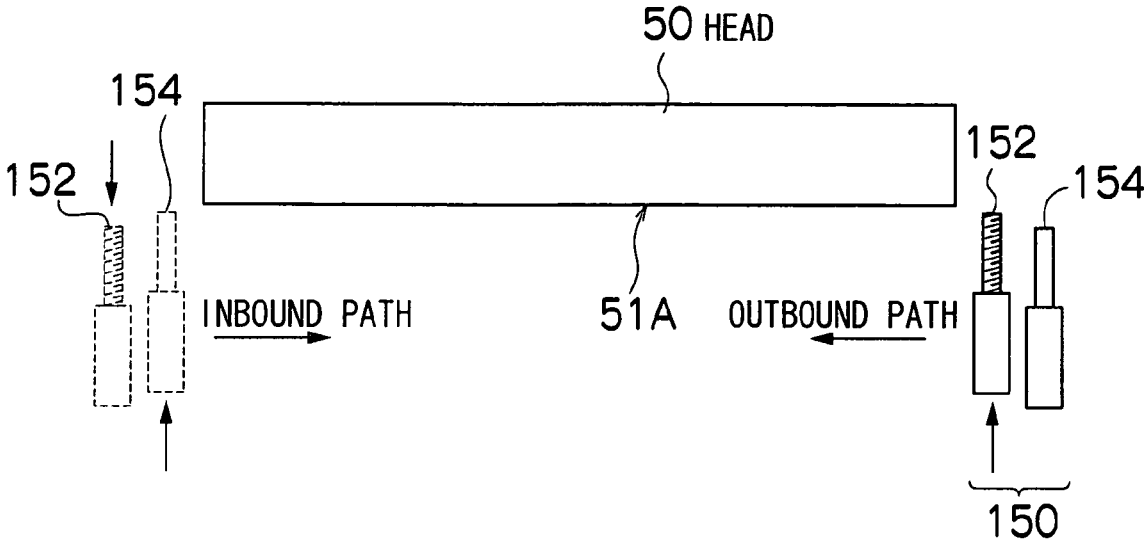
FIG. 12 is a schematic structural drawing a modified example of the nozzle surface cleaning device shown in FIG. 8.

In the modified example shown in FIG. 12, wet wiping can be performed in the outbound path, so liquids and deposits can be removed in the outbound path alone, and an aspect is possible in which wet wiping in the inbound path can be dispensed with. In the present aspect, the outbound path combines the ink absorbing step and the deposit removal step, so dry wiping can be avoided by additionally controlling the convex shape of the meniscus as a way of moistening the blade.

Figure 13:
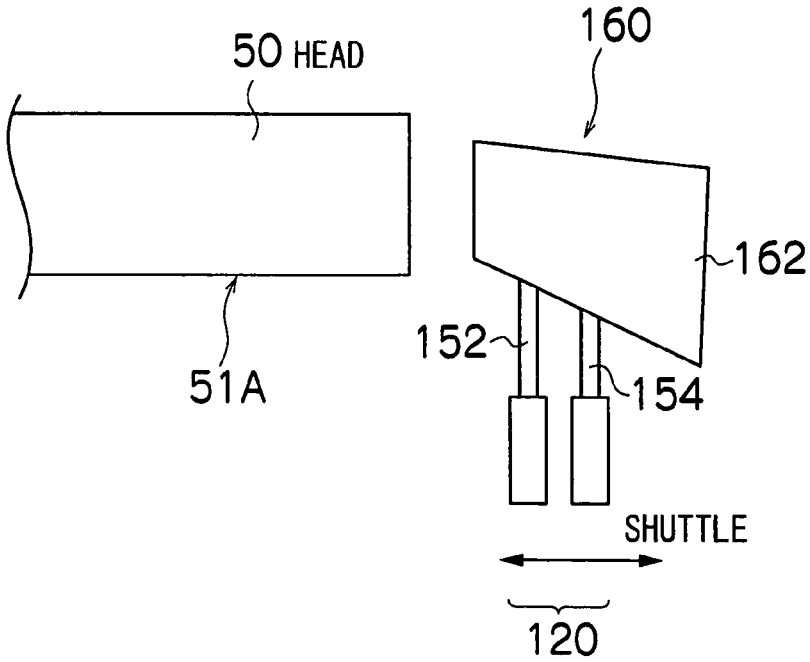
FIG. 13 is a drawing describing a modified example of the recovery device of the nozzle surface cleaning device shown in FIG. 12.

FIG. 13 shows the recovery device 160 in the present modified example. The recovery device 140 has the same configuration as that shown in FIG. 11, absorbs liquids in the ink absorbent blade 152, and has an absorber 162 for recovering ink and other liquids absorbed thereby.

The recovery device 160 is the same as the recovery device 140 shown in FIG. 11, so a description thereof is omitted.

In the inkjet recording apparatus 10 with the above configuration, ink absorption and deposit removal can be performed using the outbound path in which the print head 51 and the nozzle surface cleaning device 150 move in relation to each other, and there is an effect whereby maintenance time is reduced.

In the present embodiment, the entire area of the nozzle surface 51A is cleaned while the ink absorbent roller 66A, the ink absorbent blade 152, and the deposit removal blade 154 are moved in relative fashion in the main scanning direction of the print head 50, but also possible is a configuration in which the widths of these cleaning members are greater than the width of print head 50 in the main scanning direction, and the nozzle surface 51A is cleaned as these members are moved in a relative fashion in the sub-scanning direction of the print head 50.

An ink jet recording apparatus with a full-line print head is exemplified in the present embodiment, but the scope of application of the present invention is not limited to this option alone, and it is also possible to use a shuttle-scan inkjet recording apparatus.

A piezo-type inkjet recording apparatus is exemplified in the present embodiment, but the present invention may also be applied to thermal inkjet recording apparatuses that are provided with an energy generator inside the ink chamber and that discharge ink with bubbles generated by heating ink in the ink chamber with the energy generator. However, it is difficult to control the meniscus because of bubbles generated by the heating of ink in thermal inkjet recording apparatuses.

The scope of application of the present invention is not limited to inkjet recording apparatuses, and application may also be made to liquid discharge apparatuses for discharging water, chemical solutions, treatment solutions, and other liquids from discharge ports (nozzles) disposed in a head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a printing device including a print head which discharges ink droplets onto a recording medium to perform printing, the print head having discharge ports through which the ink droplets are discharged;

a liquid removal device which absorbs droplets deposited on an ink discharge surface of the print head in which the ink discharge ports are formed; and a deposit removal device which wipes away matter deposited on the ink discharge surface, wherein the liquid removal device and the deposit removal device are a common device that moves in a reciprocal movement relative to the print head and one continuous reciprocal movement relative to the print head includes an inbound path and an outbound path, the inbound path comprises a path from one end of the print head to an opposing end of the print head and the outbound path comprises the path from the opposing end of the print head to the one end of the print head, the common device performs one of a liquid removal and a deposit removal on the outbound path and one of the deposit removal and the liquid removal on the inbound path during said one continuous reciprocal movement, and printing is not carried out during said one continuous reciprocal movement.

2. The inkjet recording apparatus as defined in claim 1, wherein the liquid removal device has an absorber that is moistened when the droplets are absorbed.

3. The inkjet recording apparatus as defined in claim 1, further comprising a meniscus control device which controls a meniscus of ink inside each of nozzles having the discharge ports when cleaning the ink discharge surface with the liquid removal device and the deposit removal device.

4. The inkjet recording apparatus as defined in claim 1, further comprising:

a movement device which moves the liquid removal device and the deposit removal device in the reciprocal movement relative to the print head; and an ink discharge surface cleaning control device which controls ink discharge surface cleaning operations so that one of a liquid removal operation with the liquid removal device and a deposit removal operation with the deposit removal device is performed in the outbound path of the one continuous reciprocal movement, and the other of the liquid removal operation with the liquid removal device and the deposit removal operation with the deposit removal device is performed in the inbound path of the one continuous reciprocal movement.

5. The inkjet recording apparatus as defined in claim 1, further comprising:

a movement device which moves the liquid removal device and the deposit removal device in reciprocal movement relative to the print head; and an ink discharge surface cleaning control device which controls ink discharge surface cleaning operations so that a liquid removal operation with the liquid removal device is performed in the outbound path of the one continuous reciprocal movement, and a deposit removal operation with the deposit removal device is performed in the inbound path of the one continuous reciprocal movement.

6. The inkjet recording apparatus as defined in claim 1, wherein the common device comprises a rotor member that is configured to be rotatably driven during relative movement with respect to the print head.

7. The inkjet recording apparatus as defined in claim 1, further comprising:

an ink discharge surface condition determination device which determines whether the ink discharge surface is in one of a dry condition and a wet condition; and a meniscus control device which controls menisci of ink inside nozzles having the discharge ports so as to make the menisci form one of a convex shape and a concave shape with respect to an outside of the discharge ports, wherein in a case where the ink discharge surface condition determination device determines that the ink discharge surface is in the dry condition, during the outbound path of the one continuous reciprocal movement, the meniscus control device controls the menisci to be kept in the convex shape protruding from the discharge ports so that the common device comes in contact with the menisci kept in the convex shape and absorbs and removes thickened ink from surfaces of the menisci, and the common device is thereby moistened, and during the inbound path of the one continuous reciprocal movement, the meniscus control device controls the menisci to be kept in the concave shape with respect to the outside of the discharge ports, and the common device absorbs and removes the droplets deposited on the ink discharge surface, wherein in a case where the ink discharge surface condition determination device determines that the ink discharge surface is in the wet condition, during the outbound path of the one continuous reciprocal movement, the common device absorbs and removes the droplets deposited on the ink discharge surface, and the common device is thereby moistened, and during the inbound path of the one continuous reciprocal movement, the common device removes the matter deposited on the ink discharge surface.

8. The inkjet recording apparatus as defined in claim 7, wherein the ink discharge surface condition determination device includes a sensor configured to directly observe the ink discharge surface.

9. The inkjet recording apparatus as defined in claim 7, wherein:

the ink discharge surface condition determination device determines whether at least one of the discharge ports has not discharged the ink for at least a prescribed time period after an ink droplet is discharged from the one of the discharge ports, the prescribed time period denoting an amount of time between a point at which the ink droplet is discharged from the one of the discharge ports and a point at which a discharge defect is caused in the one of the discharge ports, the ink discharge surface condition determination device having a plurality of values for the prescribed time period differing according to at least one of environmental temperatures of the print head and types of the ink, the ink discharge surface condition determination device selecting one of the values for the prescribed time period according to at least one of the environmental temperature of the print head and the type of the ink being used;

when the ink discharge surface condition determination device determines that at least one of the discharge ports has not discharged the ink for at least the prescribed time period, the ink discharge surface condition determination device determines that the ink discharge surface is in the dry condition; and when the ink discharge surface condition determination device determines that none of the discharge ports has not discharged the ink for at least the prescribed time period, the ink discharge surface condition determination device determines that the ink discharge surface is in the wet condition.

10. The inkjet recording apparatus as defined in claim 7, wherein the meniscus control device includes actuators configured to apply pressure to the ink inside the nozzles, and drives, in synchronization with the reciprocal movement of the common device relative to the print head, the actuators to keep the menisci in the convex shape protruding from the discharge ports.

11. The inkjet recording apparatus as defined in claim 7, wherein:

the print head is divided into a plurality of print head blocks; and the inkjet recording apparatus further comprises:

a plurality of branch supply paths which are connected to the print head blocks, respectively;

a plurality of valves which are arranged in the branch supply paths and selectively open and close the branch supply paths, respectively; and a pump which is connected to the branch supply paths and is configured to change pressure inside the print head, wherein the meniscus control device changes the pressure inside each of the print head blocks so as to make the menisci form one of the convex shape and the concave shape with respect to the outside of the discharge ports.

12. The inkjet recording apparatus as defined in claim 7, wherein the common device includes a rotor member configured to absorb the droplets deposited on the ink discharge surface and to wipe away the matter deposited on the ink discharge surface, the rotor member being configured to be switched between driven rotation and non-driven rotation during the reciprocal movement of the common device relative to the print head, wherein in the case where the ink discharge surface condition determination device determines that the ink discharge surface is in the dry condition, during the outbound path of the one continuous reciprocal movement, the common device moves relatively to the ink discharge surface without rotatably driving the rotor member, and during the inbound path of the one continuous reciprocal movement, the common device moves relatively to the ink discharge surface with rotatably driving the rotor member, wherein in the case where the ink discharge surface condition determination device determines that the ink discharge surface is in the wet condition, during the outbound path of the one continuous reciprocal movement, the common device moves relatively to the ink discharge surface with rotatably driving the rotor member, and during the inbound path of the one continuous reciprocal movement, the common device moves relatively to the ink discharge surface without rotatably driving the rotor member.

13. The inkjet recording apparatus as defined in claim 7, wherein:

the print head is a line head having a length corresponding to a maximum width of the recording medium; and the common device reciprocally moves relatively to the print head over the length of the print head in a width direction of the recording medium so as to absorb the droplets deposited on the ink discharge surface and to wipe away the matter deposited on the ink discharge surface.

14. The inkjet recording apparatus as defined in claim 7, wherein the common device has a width greater than a width of the print head in a width direction perpendicular to a length direction of the print head parallel to a width direction of the recording medium.

15. The inkjet recording apparatus as defined in claim 7, further comprising:

a recovery device configured to recover the ink having been removed by the common device from the ink discharge surface, wherein the recovery device includes an ink absorber of which osmotic pressure is higher than the common device, and the recovery device recovers the ink from the common device by bringing the ink absorber in contact with the common device.

16. The inkjet recording apparatus as defined in claim 15, wherein:

the ink absorber has a sloping surface at a side to be in contact with the common device; and the recovery device recovers the ink from the common device by moving the common device relatively to the ink absorber along the sloping surface while pressing the common device onto the sloping surface.

17. An inkjet recording apparatus comprising:

a printing device including a print head which discharges ink droplets onto a recording medium to perform printing, the print head having discharge ports through which the ink droplets are discharged;

a liquid removal device which absorbs droplets deposited on an ink discharge surface of the print head in which the ink discharge ports are formed;

a deposit removal device which wipes away matter deposited on the ink discharge surface; and a switching device which switches between driven rotation and non-driven rotation of a rotor member, wherein:

the liquid removal device comprises the rotor member that is rotatably driven during relative movement with respect to the print head;

the deposit removal device comprises the rotor member that is shared with the liquid removal device;

the droplets deposited on the ink discharge surface are absorbed away as the rotor member is rotatably driven for a droplet removal operation by the liquid removal device, and the matter deposited on the ink discharge surface is removed as the rotor member is urged toward the ink discharge surface without being rotatably driven in a deposit removal operation with the deposit removal device;

the droplet removal operation and the deposit removal operation are carried out in one continuous reciprocal movement of the rotor member relative to the print head from one end of the print head to an opposing end of the print head; and printing is not carried out from a time that the rotor member begins one of the droplet removal operation and the deposit removal operation from said one end of the print head to the opposing end of the print head until completion of the other of the deposit removal operation and the droplet removal operation from said opposing end of the print head to said one end of the print head.

18. An ink discharge surface cleaning method in an inkjet recording apparatus comprising a printing device including a print head which discharges ink droplets onto a recording medium to perform printing, the print head having discharge ports through which the ink droplets are discharged, the method comprising:

a liquid removal step of absorbing away droplets deposited on an ink discharge surface of the print head in which the ink discharge ports are formed; and a deposit removal step of wiping away matter deposited on the ink discharge surface after the liquid removal step, wherein the liquid removal step and the deposit removal step are carried out by a common device that moves in a reciprocal movement relative to the print head and one continuous reciprocal movement relative to the print head includes an inbound path and an outbound path, the inbound path comprises a path from one end of the print head to an opposing end of the print head and the outbound path comprises the path from the opposing end of the print head to the one end of the print head, the common device performs one of the liquid removal step and the deposit removal step on the outbound path and one of the deposit removal step and the liquid removal step on the inbound path during said one continuous reciprocal movement, and printing is not carried out during said one continuous reciprocal movement.

19. The ink discharge surface cleaning method as defined in claim 18, further comprising:

an ink discharge surface condition determination step of determining whether the ink discharge surface is in one of a dry condition and a wet condition; and a meniscus control step of controlling menisci of ink inside nozzles having the discharge ports so as to make the menisci form one of a convex shape and a concave shape with respect to an outside of the discharge ports, wherein in a case where it is determined in the ink discharge surface condition determination step that the ink discharge surface is in the dry condition, during the outbound path of the one continuous reciprocal movement, the menisci are controlled to be kept in the convex shape protruding from the discharge ports so that the common device comes in contact with the menisci kept in the convex shape and absorbs and removes thickened ink from surfaces of the menisci, and the common device is thereby moistened, and during the inbound path of the one continuous reciprocal movement, the menisci are controlled to be kept in the concave shape with respect to the outside of the discharge ports, and the common device is made to absorb and remove the droplets deposited on the ink discharge surface, wherein in a case where it is determined in the ink discharge surface condition determination step that the ink discharge surface is in the wet condition, during the outbound path of the one continuous reciprocal movement, the common device is made to absorb and remove the droplets deposited on the ink discharge surface, and the common device is thereby moistened, and during the inbound path of the one continuous reciprocal movement, the common device is made to remove the matter deposited on the ink discharge surface.

20. The ink discharge surface cleaning method as defined in claim 19, wherein the ink discharge surface condition determination step is carried out by a sensor configured to directly observe the ink discharge surface.

21. The ink discharge surface cleaning method as defined in claim 19, wherein:

the ink discharge surface condition determination step includes a discharge port condition determination step of determining whether at least one of the discharge ports has not discharged the ink for at least a prescribed time period after an ink droplet is discharged from the one of the discharge ports, the prescribed time period denoting an amount of time between a point at which the ink droplet is discharged from the one of the discharge ports and a point at which a discharge defect is caused in the one of the discharge ports, the discharge port condition determination step being provided with a plurality of values for the prescribed time period differing according to at least one of environmental temperatures of the print head and types of the ink, the discharge port condition determination step including a time period selection step of selecting one of the values for the prescribed time period according to at least one of the environmental temperature of the print head and the type of the ink being used;

when it is determined in the discharge port condition determination step that at least one of the discharge ports has not discharged the ink for at least the prescribed time period, it is determined in the ink discharge surface condition determination step that the ink discharge surface is in the dry condition; and when it is determined in the discharge port condition determination step that none of the discharge ports has not discharged the ink for at least the prescribed time period, it is determined in the ink discharge surface condition determination step that the ink discharge surface is in the wet condition.

22. The ink discharge surface cleaning method as defined in claim 19, wherein the meniscus control step is carried out by actuators configured to apply pressure to the ink inside the nozzles, and includes a step of driving, in synchronization with the reciprocal movement of the common device relative to the print head, the actuators to keep the menisci in the convex shape protruding from the discharge ports.

23. The ink discharge surface cleaning method as defined in claim 19, wherein:

the print head is divided into a plurality of print head blocks; and the inkjet recording apparatus further comprises:

a plurality of branch supply paths which are connected to the print head blocks, respectively;

a plurality of valves which are arranged in the branch supply paths and selectively open and close the branch supply paths, respectively; and a pump which is connected to the branch supply paths and is configured to change pressure inside the print head, wherein the meniscus control step includes a step of changing the pressure inside each of the print head blocks so as to make the menisci form one of the convex shape and the concave shape with respect to the outside of the discharge ports.

24. The ink discharge surface cleaning method as defined in claim 19, wherein the common device includes a rotor member configured to absorb the droplets deposited on the ink discharge surface and to wipe away the matter deposited on the ink discharge surface, the rotor member being configured to be switched between driven rotation and non-driven rotation during the reciprocal movement of the common device relative to the print head, wherein in the case where it is determined in the ink discharge surface condition determination step that the ink discharge surface is in the dry condition, during the outbound path of the one continuous reciprocal movement, the common device is made to move relatively to the ink discharge surface without rotatably driving the rotor member, and during the inbound path of the one continuous reciprocal movement, the common device is made to move relatively to the ink discharge surface with rotatably driving the rotor member, wherein in the case where it is determined in the ink discharge surface condition determination step that the ink discharge surface is in the wet condition, during the outbound path of the one continuous reciprocal movement, the common device is made to move relatively to the ink discharge surface with rotatably driving the rotor member, and during the inbound path of the one continuous reciprocal movement, the common device is made to move relatively to the ink discharge surface without rotatably driving the rotor member.

25. The ink discharge surface cleaning method as defined in claim 19, wherein:

the print head is a line head having a length corresponding to a maximum width of the recording medium; and the common device is made to reciprocally move relatively to the print head over the length of the print head in a width direction of the recording medium so as to absorb the droplets deposited on the ink discharge surface and to wipe away the matter deposited on the ink discharge surface.

26. The ink discharge surface cleaning method as defined in claim 19, wherein the common device has a width greater than a width of the print head in a width direction perpendicular to a length direction of the print head parallel to a width direction of the recording medium.

27. The ink discharge surface cleaning method as defined in claim 19, further comprising:

a recovery step of recovering the ink having been removed by the common device from the ink discharge surface, wherein the recovery step is carried out by an ink absorber of which osmotic pressure is higher than the common device, and the recovery step includes a step of recovering the ink from the common device by bringing the ink absorber in contact with the common device.

28. The ink discharge surface cleaning method as defined in claim 27, wherein:

the ink absorber has a sloping surface at a side to be in contact with the common device; and the recovery step includes a step of recovering the ink from the common device by moving the common device relatively to the ink absorber along the sloping surface while pressing the common device onto the sloping surface.

29. A cleaning apparatus for a droplet discharge surface in which discharge ports for discharging droplets are formed, the cleaning apparatus comprising:

a liquid removal device which absorbs droplets deposited on the droplet discharge surface; and a deposit removal device which wipes away matter deposited on the droplet discharge surface, wherein the liquid removal device and the deposit removal device are a common device that moves in a reciprocal movement relative to the droplet discharge surface, with one continuous reciprocal movement relative to the droplet discharge surface including an inbound path and an outbound path, the inbound path comprises a path from one end of the droplet discharge surface to an opposing end of the droplet discharge surface and the outbound path comprises the path from the opposing end of the droplet discharge surface to the one end of the droplet discharge surface, the common device performs one of a liquid removal and a deposit removal on the outbound path and one of the deposit removal and the liquid removal on the inbound path during said one continuous reciprocal movement, and normal discharging droplets is not carried out during said one continuous reciprocal movement.

30. The cleaning apparatus as defined in claim 29, wherein the liquid removal device has an absorber that is moistened when the droplets are absorbed.

31. The cleaning apparatus as defined in claim 29, further comprising:

a movement device which moves the liquid removal device and the deposit removal device in reciprocal movement in a width direction of the droplet discharge surface relative to the droplet discharge surface; and a droplet discharge surface cleaning control device which controls droplet discharge surface cleaning operations so that one of a liquid removal operation with the liquid removal device and a deposit removal operation with the deposit removal device is performed in the outbound path of the one continuous reciprocal movement, and the other of the liquid removal operation with the liquid removal device and the deposit removal operation with the deposit removal device is performed in the inbound path of the one continuous reciprocal movement.

32. The cleaning apparatus as defined in claim 29, further comprising a meniscus control device which controls a meniscus of liquid inside each of nozzles having the discharge ports when cleaning the droplet discharge surface with the liquid removal device and the deposit removal device.

33. The cleaning apparatus as defined in claim 29, further comprising:

a movement device which moves the liquid removal device and the deposit removal device in reciprocal movement in a width direction of the droplet discharge surface relative to the droplet discharge surface; and a droplet discharge surface cleaning control device which controls droplet discharge surface cleaning operations so that a liquid removal operation with the liquid removal device is performed in the outbound path of the one continuous reciprocal movement, and a deposit removal operation with the deposit removal device is performed in the inbound path of the one continuous reciprocal movement.

34. The cleaning apparatus as defined in claim 29, wherein the common device comprises a rotor member that is configured to be rotatably driven during relative movement with respect to the droplet discharge surface.

35. A cleaning apparatus for a droplet discharge surface in which discharge ports for discharging droplets are formed, the cleaning apparatus comprising:

a liquid removal device which absorbs droplets deposited on the droplet discharge surface;

a deposit removal device which wipes away matter deposited on the droplet discharge surface; and a switching device which switches between driven rotation and non-driven rotation of a rotor member, wherein:

the liquid removal device comprises the rotor member that is rotatably driven during relative movement with respect to the droplet discharge surface;

the deposit removal device comprises the rotor member that is shared with the liquid removal device;

the droplets deposited on the droplet discharge surface are absorbed away as the rotor member is rotatably driven for a droplet removal operation by the liquid removal device, and the matter deposited on the droplet discharge surface is removed as the rotor member is urged toward the droplet discharge surface without being rotatably driven in a deposit removal operation with the deposit removal device;

the droplet removal operation and the deposit removal operation are carried out in one continuous reciprocal movement of the rotor member relative to the droplet discharge surface from one end of the droplet discharge surface to an opposing end of the droplet discharge surface; and normal discharging droplets is not carried out from a time that the rotor member begins one of the droplet removal operation and the deposit removal operation from said one end of the droplet discharge surface to the opposing end of the droplet discharge surface until completion of the other of the deposit removal operation and the droplet removal operation from said opposing end of the droplet discharge surface to said one end of the droplet discharge surface.

* * * * *